US011427984B2

(12) United States Patent
Roh et al.

(10) Patent No.: US 11,427,984 B2
(45) Date of Patent: Aug. 30, 2022

(54) WORK MACHINE

(71) Applicant: Hitachi Construction Machinery Co., Ltd., Tokyo (JP)

(72) Inventors: Joonyoung Roh, Kasumigaura (JP); Kunitsugu Tomita, Kashiwa (JP); Satoshi Nakamura, Hitachinaka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 367 days.

(21) Appl. No.: 16/645,694

(22) PCT Filed: Mar. 27, 2019

(86) PCT No.: PCT/JP2019/013429
§ 371 (c)(1),
(2) Date: Mar. 9, 2020

(87) PCT Pub. No.: WO2019/189503
PCT Pub. Date: Oct. 3, 2019

(65) Prior Publication Data

US 2020/0277753 A1 Sep. 3, 2020

(30) Foreign Application Priority Data

Mar. 28, 2018 (JP) ..... JP2018-063114

(51) Int. Cl.
*E02F 3/43* (2006.01)
*E02F 9/20* (2006.01)
*E02F 9/26* (2006.01)

(52) U.S. Cl.
CPC ..... *E02F 3/435* (2013.01); *E02F 9/2029* (2013.01); *E02F 9/26* (2013.01)

(58) Field of Classification Search
CPC . E02F 3/435; E02F 9/2029; E02F 9/26; E02F 9/264
See application file for complete search history.

(56) References Cited

U.S. PATENT DOCUMENTS 5,701,691 A * 12/1997 Watanabe ..... E02F 3/435 701/50
5,826,666 A * 10/1998 Tozawa ..... E02F 3/437 172/7

(Continued)

FOREIGN PATENT DOCUMENTS

JP 2000-291076 A 10/2000
JP 2016-160718 A 9/2016

(Continued)

OTHER PUBLICATIONS

International Search Report (PCT/ISA/210) issued in PCT Application No. PCT/JP2019/013429 dated May 28, 2019 with English translation (two (2) pages).

(Continued)

*Primary Examiner* — Tyler J Lee
(74) *Attorney, Agent, or Firm* — Crowell & Moring LLP

(57) ABSTRACT

An excavation load calculated by an excavation load calculating section and an excavation distance calculated by an excavation distance calculating section are stored in a work result storage section in association with each other. A correspondence relation setting section sets correspondence relation between a target excavation load and a target excavation distance on the basis of a tendency of correspondence relation between the excavation load and the excavation distance stored in the work result storage section. The target excavation load is set on the basis of rated capacity information of a bucket. A target excavation distance calculating section calculates the target excavation distance on the basis of the correspondence relation set by the correspondence relation setting section and the target excavation load. The target excavation distance is displayed on a monitor.

8 Claims, 36 Drawing Sheets

(56) References Cited

U.S. PATENT DOCUMENTS

| | | | | |
|---|---|---|---|---|
| 5,968,104 | A * | 10/1999 | Egawa | E02F 9/2285 701/50 |
| 9,043,098 | B2 * | 5/2015 | Nomura | E02F 3/32 701/445 |
| 9,752,298 | B2 * | 9/2017 | Nakamura | E02F 9/2029 |
| 2012/0246981 | A1 * | 10/2012 | Magaki | E02F 9/2075 414/685 |
| 2015/0354178 | A1 | 12/2015 | Jeong | |
| 2016/0258128 | A1 | 9/2016 | Nakamura et al. | |
| 2018/0313062 | A1 | 11/2018 | Tsukamoto | |

FOREIGN PATENT DOCUMENTS

| | | | |
|---|---|---|---|
| JP | 2017-14726 | A | 1/2017 |
| KR | 10-2014-0083152 | A | 7/2014 |
| WO | WO 2017/115810 | A1 | 7/2017 |

OTHER PUBLICATIONS

Japanese-language Written Opinion (PCT/ISA/237) issued in PCT Application No. PCT/JP2019/013429 dated May 28, 2019 (three (3) pages).

International Preliminary Report on Patentability (PCT/IB/338 & PCT/IB/373) issued in PCT Application No. PCT/JP2019/013429 dated Oct. 8, 2020, including English translation of document C2 (Japanese-language Written Opinion (PCT/ISA/237) filed on Mar. 9, 2020) (six (6) pages).

Korean-language Office Action issued in Korean Application No. 10-2020-7006307 dated Sep. 27, 2021 (four (4) pages).

* cited by examiner (a)

(b)

| EXCAVATION ID | EXCAVATION LOAD [ton] | EXCAVATION DISTANCE (D1)[m] |
|---|---|---|
| 1 | 67 | 20 |
| 2 | 78 | 21 |
| 3 | 70 | 20 |
| 4 | 42 | 16 |
| ... | ... | ... |

(e)

| EXCAVATION LOAD INTERVAL | | EXCAVATION DISTANCE REPRESENTATIVE VALUE |
|---|---|---|
| lower | upper | |
| ... | ... | ... |
| $w_i$ | $w_{i+1}$ | $D_{rep\,i}$ |
| $w_{i+1}$ | $w_{i+2}$ | $D_{rep\,i+1}$ |
| $w_{i+2}$ | $w_{i+3}$ | $D_{rep\,i+2}$ |
| ... | ... | ... |

FIG. 30

| | EXCAVATION ID | EXCAVATION LOAD [ton] | FIRST EXCAVATION DISTANCE (D1)[m] | SECOND EXCAVATION DISTANCE (D2)[m] |
|---|---|---|---|---|
| | 1 | 67 | 20 | 14 |
| | 2 | 78 | 21 | 15 |
| | 3 | 70 | 20 | 14 |
| | 4 | 42 | 16 | 10 |
| | ... | ... | ... | ... |

| EXCAVATION LOAD INTERVAL | | FIRST EXCAVATION DISTANCE REPRESENTATIVE VALUE |
|---|---|---|
| lower | upper | |
| ... | ... | ... |
| $w_i$ | $w_{i+1}$ | $D1_{rep\,i}$ |
| $w_{i+1}$ | $w_{i+2}$ | $D1_{rep\,i+1}$ |
| ... | ... | ... |

| FIRST EXCAVATION DISTANCE RANGE | EXCAVATION LOAD INTERVAL | | SECOND EXCAVATION DISTANCE REPRESENTATIVE VALUE |
|---|---|---|---|
| | lower | upper | |
| ... | ... | ... | ... |
| $dI_{lower} \leqq DI < dI_{upper}$ | $w_i$ | $w_{i+1}$ | $D2_{rep\ i}$ |
| | $w_{i+1}$ | $w_{i+2}$ | $D2_{rep\ i+1}$ |
| | $w_{i+2}$ | $w_{i+3}$ | $D2_{rep\ i+2}$ |
| | ... | ... | ... |

WORK MACHINE

TECHNICAL FIELD

The present invention relates to a work machine including a controller that calculates the load value of an excavation target object transported by a work device.

BACKGROUND ART

Generally, on a strip mine, mineral excavation and transportation work is continuously performed by a work machine typified by a hydraulic excavator and a transporting machine typified by a dump truck. A maximum loading amount is set to the transporting machine. When a mineral as an excavation target object is loaded exceeding the maximum loading amount, the moving speed of the transporting machine is decreased, and further there is a possibility of causing damage to the transporting machine. Thus, the load needs to be reloaded so as to make an amount of loading on the transporting machine equal to or less than the maximum loading amount. The reloading causes a loss of time, and therefore decreases productivity at the mine. In addition, it is clear that when the amount of loading falls significantly below the maximum loading amount, the capability of the transporting machine cannot be exerted sufficiently, and therefore the productivity at the mine is decreased. Thus, in improving the productivity at the mine, bringing the amount of loading on the transporting machine close to the maximum loading amount is an important element. For this purpose, it is important to bring an excavation load obtained by one excavation operation of the work machine close to a target value.

In relation to this kind of technology, Patent Document 1 discloses a work machine that includes: a controller that, on the basis of a supposed amount of excavation by one excavation operation of the work machine, determines an area in which the supposed amount of excavation is obtained from an excavation target by one excavation operation of the work machine as an area to be excavated, and calculates the work position of the work machine in performing a next excavation operation on the basis of the area to be excavated; and a display device that displays information regarding the work position of the work machine in performing the next excavation operation.

PRIOR ART DOCUMENT

Patent Document

Patent Document 1: JP-2017-014726-A

SUMMARY OF THE INVENTION

Problem to be Solved by the Invention

The technology of Patent Document 1 provides an operator of the work machine with the work position of the work machine in performing the next excavation operation, that is, the stop position of the work machine which stop position is suitable for the next excavation. However, depending on the experience and skill of the operator, the operator may not know how far to extend a front work device in front of a machine body in starting excavation work to obtain a target excavation load, and therefore only the provision of information of the stop position of the work machine may be insufficient. That is, it may be difficult to bring an excavation load obtained by the work machine close to a target value on the basis of only the information provided by Patent Document 1.

The present invention has been made in view of the above-described circumstances. It is an object of the present invention to provide a work machine that makes it possible to bring an excavation load close to a target value irrespective of the experience and skill of an operator.

Means for Solving the Problem

The present application includes a plurality of means for solving the above-described problem. To cite an example of the means, there is provided a work machine including: a work device having a bucket; an actuator configured to drive the work device; a controller configured to determine excavation work being performed by the work device on a basis of at least one of posture information of the work device and load information of the actuator, and calculate an excavation load as a load value of an excavation target object excavated by the work device; and a display device configured to display the calculated excavation load; the controller calculates, as an excavation distance, any one of a distance from a reference point set to the work machine to a reference point set to the bucket when it is determined that the excavation work is being performed and a distance by which the reference point set to the bucket moves while it is determined that the excavation work is being performed, on a basis of the posture information of the work device, stores the calculated excavation load and the calculated excavation distance in association with each other, sets correspondence relation between a target excavation load as a target value of the excavation load and a target excavation distance as a target value of the excavation distance on a basis of a tendency of correspondence relation between the stored excavation load and the stored excavation distance, sets the target excavation load on a basis of rated capacity information of the bucket, and calculates the target excavation distance on a basis of the set correspondence relation and the set target excavation load, and the display device displays the calculated target excavation distance.

Advantages of the Invention

According to the present invention, it is possible to bring an excavation load close to a target value irrespective of the experience and skill of an operator.

BRIEF DESCRIPTION OF THE DRAWINGS

FIG. 30 is a diagram illustrating an example of a form in which an excavation load and a first excavation distance D1 and a second excavation distance D2 are stored as one set of data in the work result storage section 54.

MODES FOR CARRYING OUT THE INVENTION

Embodiments of the present invention will hereinafter be described with reference to the drawings. In the following, description will be made of a case where a hydraulic excavator is used as a loading machine constituting a load measuring system of a work machine, and a dump truck is used as a transporting machine.

The work machine (loading machine) covered by the present invention is not limited to a hydraulic excavator having a bucket as an attachment of a front work device, but includes hydraulic excavators having an object capable of retaining and releasing an object being transported, such as a grapple, a lifting magnet, or the like. In addition, the present invention is applicable also to wheel loaders and the like having a work arm without a swing function such as that of a hydraulic excavator.

First Embodiment

—General Configuration—

Figure 1:
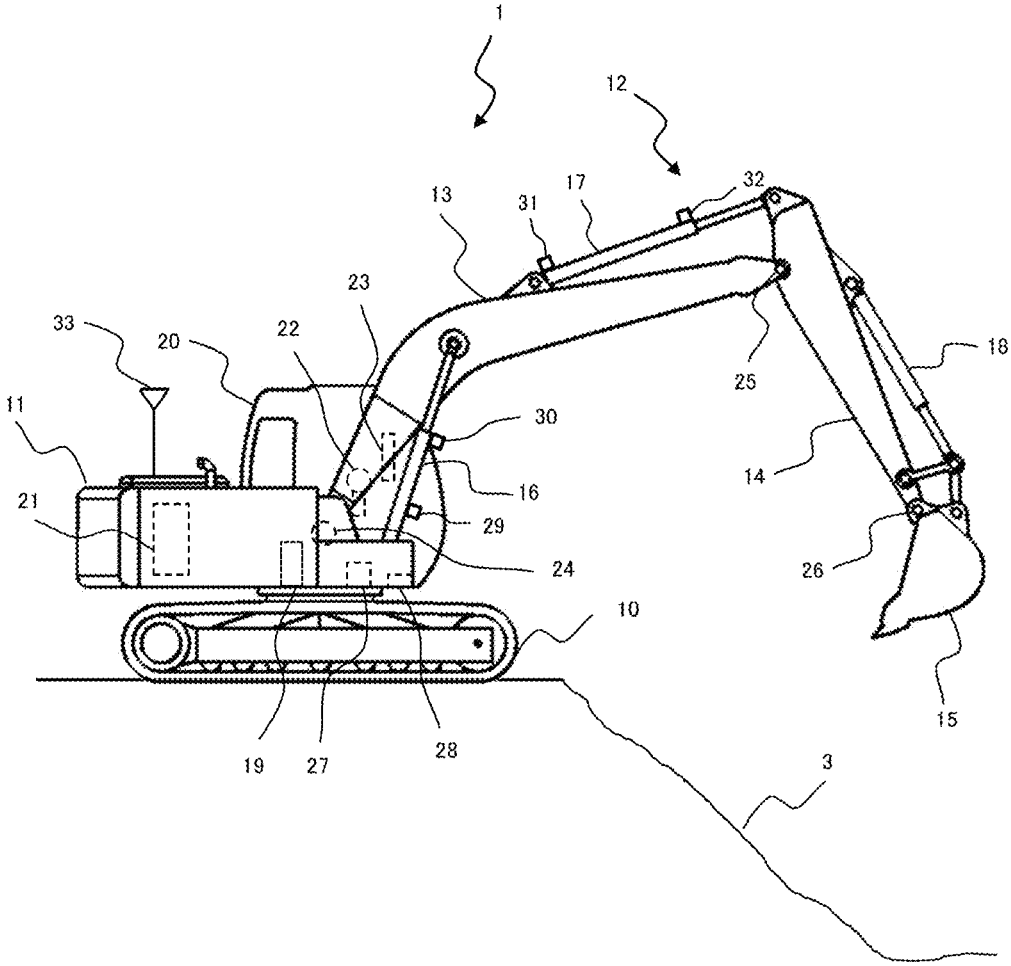
FIG. 1 is a side view of a hydraulic excavator according to a first embodiment.

FIG. 1 is a side view of a hydraulic excavator according to a present embodiment. The hydraulic excavator 1 in FIG. 1 includes: a lower track structure 10; an upper swing structure 11 disposed so as to be swingable on an upper portion of the lower track structure 10; a front work device 12 as an articulated work arm mounted in front of the upper swing structure 11; a swing motor 19 as a hydraulic motor that rotates the upper swing structure 11; an operation room (cab) 20 that is provided to the upper swing structure 11 and which an operator boards to operate the excavator 1; control levers (operation device) 22 (22*a* and 22*b*) provided within the operation room 20 to control operation of actuators included in the hydraulic excavator 1; and a controller 21 that includes a storage device (for example, a ROM and a RAM), a calculation processing unit (for example, a CPU), and an input-output device, and controls the operation of the hydraulic excavator 1.

The front work device 12 includes a boom 13 rotatably provided to the upper swing structure 11, an arm 14 rotatably provided to an end of the boom 13, and a bucket (attachment) 15 rotatably provided to an end of the arm 14. In addition, the front work device 12 includes, as actuators driving the front work device 12, a boom cylinder 16 as a hydraulic cylinder driving the boom 13, an arm cylinder 17 as a hydraulic cylinder driving the arm 14, and a bucket cylinder 18 as a hydraulic cylinder driving the bucket 15.

A boom angle sensor 24, an arm angle sensor 25, and a bucket angle sensor 26 are attached to pivots of the boom 13, the arm 14, and the bucket 15, respectively. The respective rotational angles of the boom 13, the arm 14, and the bucket 15 can be obtained from these angle sensors 24, 25, and 26. In addition, a swing angular velocity sensor (gyroscope, for example) 27 and an inclination angle sensor 28 are attached to the upper swing structure 11, and are respectively configured to be able to obtain the swing angular velocity of the upper swing structure 11 and the angle of inclination in a front-rear direction of the upper swing structure 11. Posture information identifying the posture of the front work device 12 can be obtained from detected values of the angle sensors 24, 25, 26, 27, and 28.

A boom bottom pressure sensor 29, a boom rod pressure sensor 30, an arm bottom pressure sensor 31, and an arm rod pressure sensor 32 are respectively attached to the boom cylinder 16 and the arm cylinder 17, and are configured to be able to obtain pressures within the respective hydraulic cylinders. Driving force information identifying the thrusts of the respective cylinders 16 and 18, that is, driving forces applied to the front work device 12, and load information identifying loads on the respective cylinders 16 and 18 can be obtained from detected values of the pressure sensors 29, 30, 31, and 32. Incidentally, similar pressure sensors may be provided also to a bottom side and a rod side of the bucket cylinder 18, and driving force information and load information of the bucket cylinder 18 may be obtained to be used for various kinds of control.

Incidentally, the boom angle sensor 24, the arm angle sensor 25, the bucket angle sensor 26, the inclination angle sensor 28, and the swing angular velocity sensor 27 can be replaced with other sensors as long as the other sensors can detect physical quantities from which the posture information of the front work device 12 can be calculated. For example, the boom angle sensor 24, the arm angle sensor 25 and the bucket angle sensor 26 can each be replaced with an inclination angle sensor or an inertial measurement unit (IMU). In addition, the boom bottom pressure sensor 29, the boom rod pressure sensor 30, the arm bottom pressure sensor 31, and the arm rod pressure sensor 32 can be replaced with other sensors as long as the other sensors can detect physical quantities from which the thrusts generated by the boom cylinder 16 and the arm cylinder 17, that is, the driving force information applied to the front work device 12, and the load information of the respective cylinders 16 and 17 can be calculated. Further, the operation of the front work device 12 may be detected by detecting the operation speeds of the boom cylinder 16 and the arm cylinder 17 by stroke sensors or detecting the operation speeds of the boom 13 and the arm 14 by IMUs in place of or in addition to the detection of the thrusts, the driving forces, and the loads.

Installed within the operation room 20 are a monitor (display device) 23 that displays a result of calculation in the controller 21 (for example, a transport load as the load value of an excavation target object 4 within the bucket 15 which load value is calculated by an excavation load calculating section 53 and an amount of loading on the transporting machine as an integrated value of the load value) and the like and control levers 22 (22*a* and 22*b*) for giving instructions for operation of the front work device 12 and the upper swing structure 11. Attached to the upper surface of the upper swing structure 11 is a communication antenna 33 as an external communication device for the controller 21 to communicate with an external computer or the like (for example, a controller mounted in a dump truck 2 as a transporting machine (see FIG. 2)).

The monitor 23 of the present embodiment has a touch panel, and thus functions also as an input device for the operator to input information to the controller 21. A liquid crystal display having the touch panel, for example, can be used as the monitor 23.

The control lever 22*a* gives respective instructions for the raising and lowering of the boom 13 (expansion and contraction of the boom cylinder 16) and the dumping and crowding of the bucket 15 (expansion and contraction of the bucket cylinder 18). The control lever 22*b* gives respective instructions for the dumping and crowding of the arm 14 (expansion and contraction of the arm cylinder 17) and the left and right swinging of the upper swing structure 11 (left and right rotation of the hydraulic motor 19). The control lever 22*a* and the control lever 22*b* are two-composite multifunctional control levers. The forward and rearward operations of the control lever 22*a* correspond to the raising and lowering of the boom 13. The left and right operations of the control lever 22*a* correspond to the crowding and dumping of the bucket 15. The forward and rearward operations of the control lever 22*b* correspond to the dumping and crowding of the arm 14. The left and right operations of the control lever 22*b* correspond to the left and right rotations of the upper swing structure 11. When a lever is operated in an oblique direction, two corresponding actuators operate at the same time. In addition, operation amounts of the control levers 22*a* and 22*b* define the operation speeds of the actuators 16 to 19.

Figure 2:
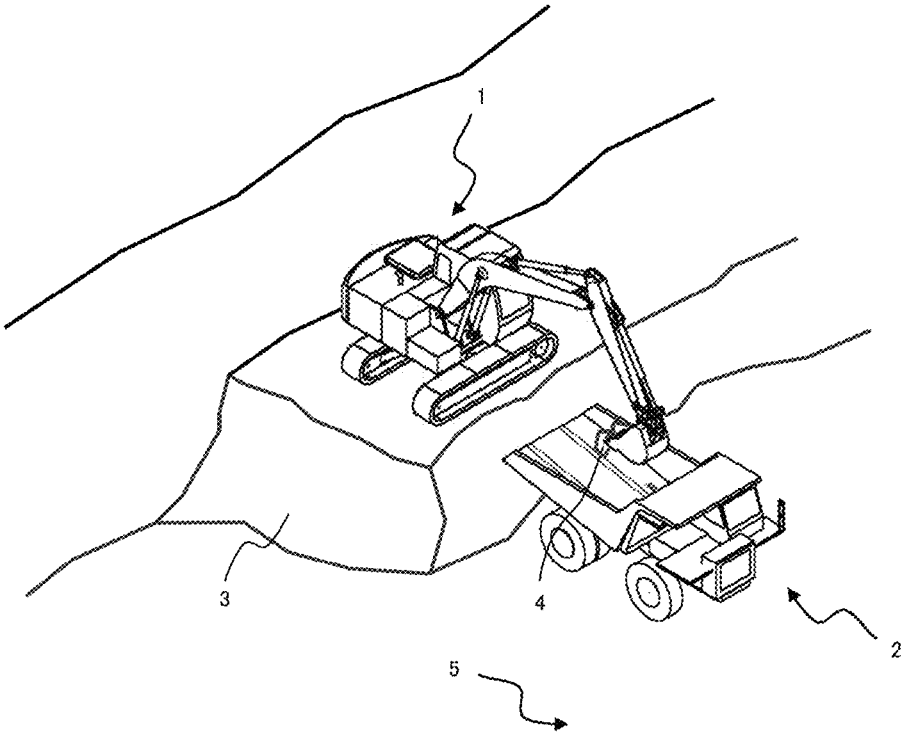
FIG. 2 is an overview diagram illustrating an example of work by the hydraulic excavator according to the first embodiment.

FIG. 2 is an overview diagram illustrating an example of work of the hydraulic excavator 1. The hydraulic excavator 1 generally repeats "excavation work" of excavating an excavation target object 3 and loading an excavation target object 4 into the bucket 15, "transporting work" of swinging after the excavation work and moving the bucket 15 to a position above the bed of the transporting machine 2 on a travelling surface 5, "loading work" of discharging the excavation target object 4 onto the transporting machine 2 after the transporting work, and "reaching work" of moving the bucket 15 to the position of the excavation target 3 after the loading work. The hydraulic excavator 1 thereby fills the bed of the transporting machine 2 with the excavation target object 4. Generally, the transporting machine 2 has a loading upper limit referred to as a maximum loading amount, and the transporting machine 2 is determined to be filled when the maximum loading amount is reached. When the excavation target object 4 is excessively loaded onto the bed of the transporting machine 2, overloading occurs, which invites reloading work and damage to the transporting machine 2. In addition, when an excessively small amount is loaded, an amount of transportation is small, and thus work efficiency at the site is decreased. Hence, an amount of loading onto the transporting machine 2 needs to be appropriate.

An excavation distance and relation between the excavation distance and an excavation load will be described with reference to FIG. 3 and FIG. 4. In the present document, distance information defining at least one of the position of the bucket 15 at a time of a start of excavation work by the front work device 12 and the position of the bucket 15 at a time of an end of the excavation work will be referred to collectively as an "excavation distance," and the load value of the excavation target object 4 excavated by the front work device 12 and loaded into the bucket 15 will be referred to as an "excavation load."

In addition, the excavation distance can also be said to be at least one of a distance at a certain time (for example, a time of a start of excavation or a time of an end of the excavation) during the excavation work from a reference point set to a main body (the upper swing structure 11 and the lower track structure 10) of the hydraulic excavator 1 to a reference point set to the bucket 15 and a distance by which the reference point set to the bucket 15 moves during the excavation work (for example, a period from the time of the start of the excavation to the time of the end of the excavation). The excavation distance can be defined by two reference points spatially separated from each other at a same time or different times. In the present document, one of the two reference points will be set to be the claw tip position of the bucket 15 at at least one of the time of the start of the excavation work and the time of the end of the excavation work. However, the reference point on the bucket side does not necessarily need to be the claw tip, but may be set to another point as long as the other point is a position on the bucket 15. Incidentally, in the present embodiment, the other reference point defining the excavation distance is set to be the swing center of the upper swing structure 11, but may be set to another point as long as the other point is a point on the main body side of the hydraulic excavator including the lower track structure.

The excavation distance includes: (1) an "excavation start distance" (first excavation distance) representing a distance from the predetermined reference point set to the hydraulic excavator 1 to an excavation start position (bucket claw tip position at the time of the start of the excavation work); (2) an "excavation moving distance" as a distance from the excavation start position to an excavation end position (bucket claw tip position at the time of the end of the excavation work); and (3) an "excavation trajectory length" as the length of a trajectory along which the control point of the bucket 15 moves from the excavation start position to the excavation end position. Of these three kinds of excavation distances, "(1) the excavation start distance" is distance information related to the bucket claw tip position at the time of the start of the excavation work (which distance information will be referred to as a "first excavation distance"), and "(2) the excavation moving distance" and "(3) the excavation trajectory length" are distance information related to the bucket claw tip position at the time of the end of the excavation work (which distance information will be referred to as a "second excavation distance"). FIG. 3 illustrates a concrete example of the excavation start distance among these excavation distances.

Figure 3:
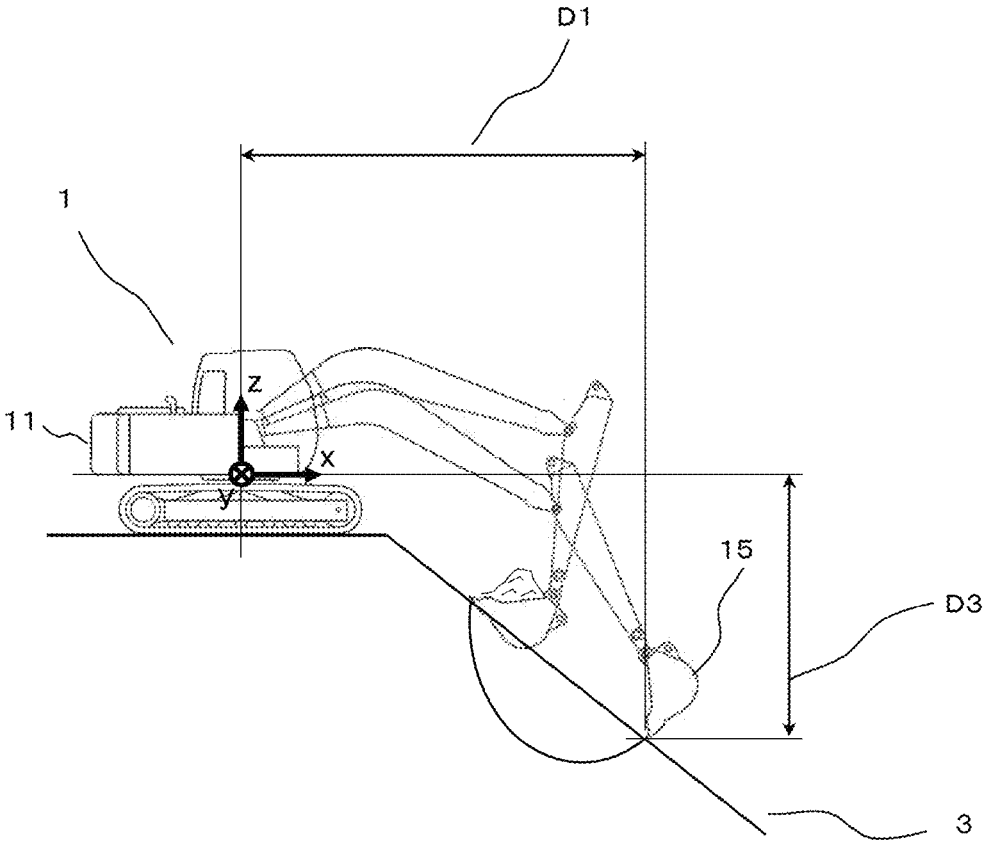
FIG. 3 is a diagram of assistance in explaining an excavation distance.

In FIG. 3, cited as examples of (1) the excavation start distance (first excavation distance) are a horizontal distance (horizontal excavation start distance) D1 from the swing center of the upper swing structure 11 to the excavation start position and a vertical distance (vertical excavation start distance) D3 from the bottom surface of the upper swing structure 11 to the excavation start position. In the present embodiment, the distance D1 in the horizontal direction from the swing center of the upper swing structure 11 to the excavation start position is calculated as an excavation distance. For example, the horizontal excavation start distance D1 can be calculated by detecting a start of excavation work from the values of signals of the arm bottom pressure sensor 31 and the arm rod pressure sensor 32, calculating the claw tip position of the bucket 15 at the time of the start of the excavation work on the basis of posture information obtained from the values of signals of the sensors 24 to 26 and the inclination sensor 28, and calculating a horizontal distance from the claw tip position to the swing center of the upper swing structure 11. The claw tip position of the bucket 15 can be defined as a point on a coordinate system set to the upper swing structure 11, the coordinate system being an orthogonal coordinate system having the swing center of the upper swing structure 11 as a vertical axis. For example, as illustrated in FIG. 3, in a case where an orthogonal coordinate system having the swing center of the upper swing structure 11 as a z-axis, having a left-right direction in the bottom surface of the upper swing structure 11 as a y-axis (where a left direction is positive), and having a front-rear direction in the bottom surface of the upper swing structure 11 as an X-axis (where a forward direction is positive) is set as a machine body coordinate system, the horizontal excavation start distance D1 is calculated as the coordinate value of an x-coordinate of the bucket claw tip position, and the vertical excavation start distance D3 is calculated as the coordinate value of a z-coordinate of the bucket claw tip position.

As for the other excavation distance (second excavation distance), cited as examples of (2) the excavation moving distance are a horizontal distance (horizontal excavation moving distance) D2 (see FIG. 27, for example) from the excavation start position to the excavation end position and a vertical distance (vertical excavation moving distance) D4 (see FIG. 27, for example) from the excavation start position to the excavation end position. As (3) the excavation trajectory length, there is an excavation trajectory length D5 (see FIG. 27, for example) as the length of a trajectory along which the claw tip of the bucket 15 moves from the excavation start position to the excavation end position.

Figure 4:
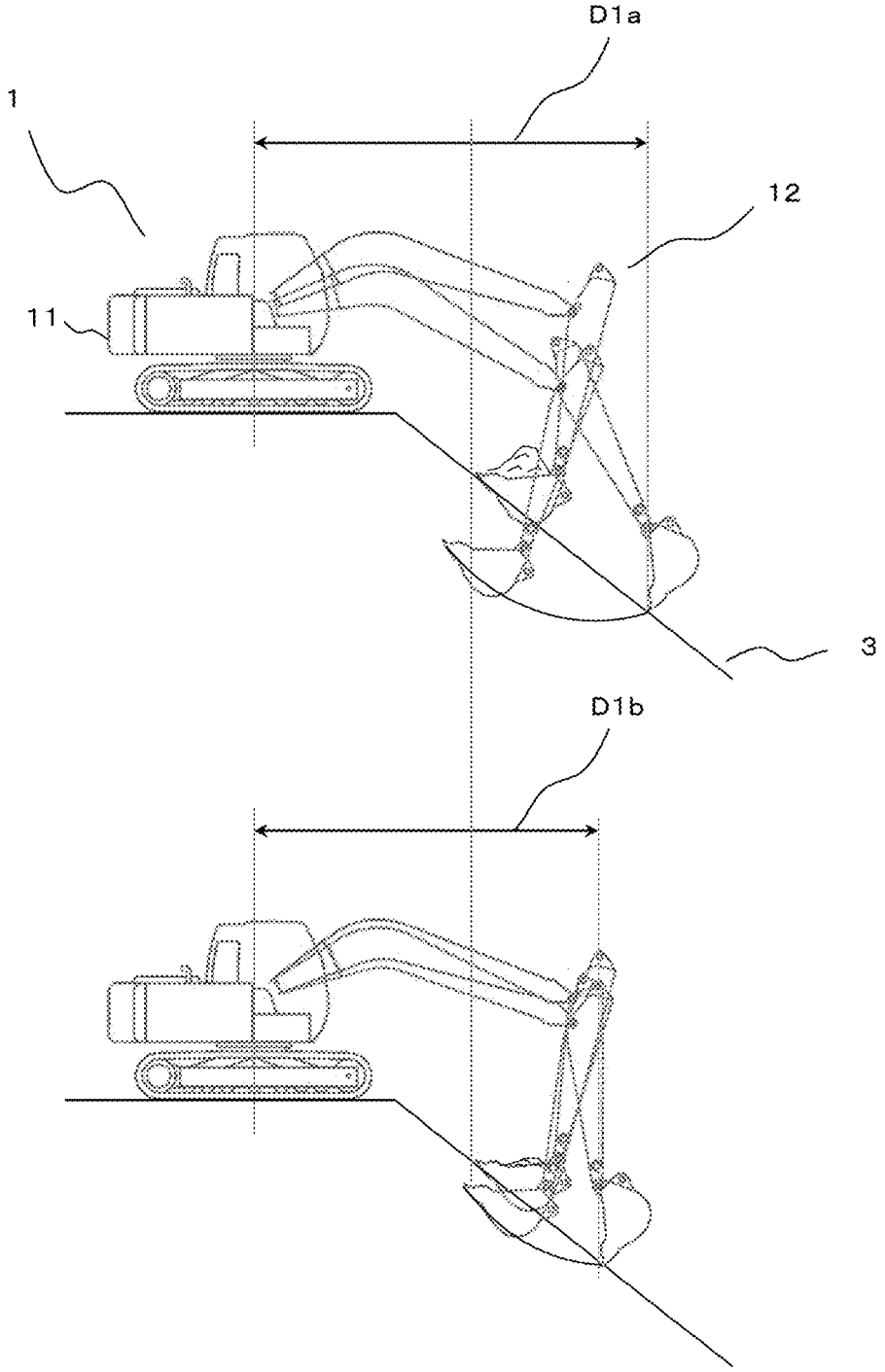
FIG. 4 is a diagram of assistance in explaining relation between an excavation distance and an excavation load.

FIG. 4 is a schematic diagram of an example illustrating relation between the excavation distance and the excavation load. An operator of the hydraulic excavator 1 performs excavation work on the excavation target object 3 by operating the front work device 12 of the hydraulic excavator 1 (the boom cylinder, the arm cylinder, and the bucket cylinder are not illustrated in FIG. 4). In a case where the excavation load needs to be adjusted, particularly at a site where excavation and loading work is repeatedly performed on a bench, the operator can adjust the excavation load by adjusting the excavation distance. For example, when the distance (horizontal excavation start distance) D1 in the horizontal direction from the swing center of the upper swing structure 11 to the excavation start position is regarded as the excavation distance, an excavation distance D1*a* in a situation in an upper part of FIG. 4 is longer than a value D1*b* in a situation in a lower part of the figure. That is, the front work device 12 is extended farther, and it is therefore easy to excavate a larger amount of the excavation target object.

Next, referring to FIG. 5 and FIG. 6, description will be made of a configuration of an excavation and loading work guidance system included in the hydraulic excavator 1 according to the present embodiment.

Figure 5:
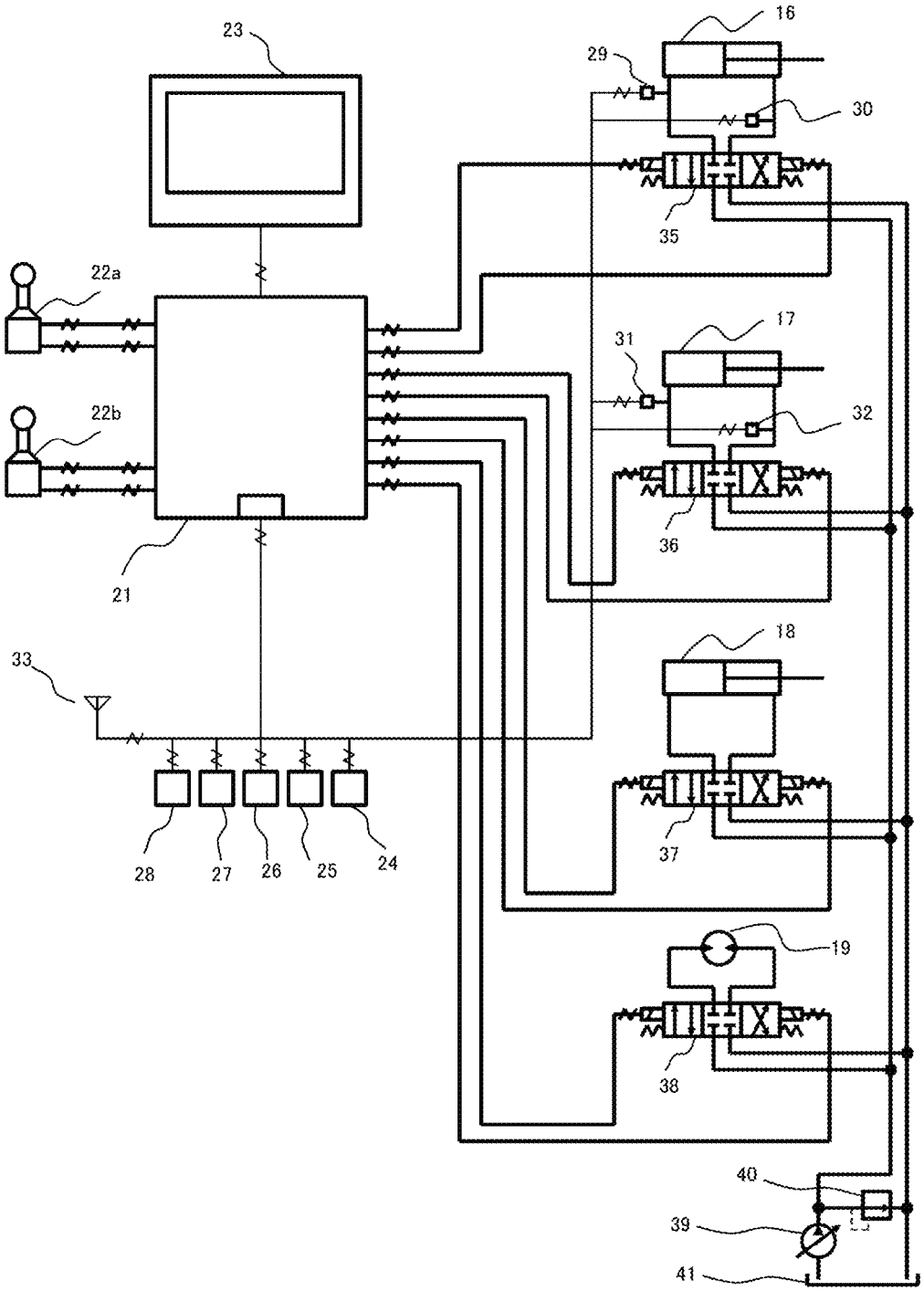
FIG. 5 is a schematic diagram of a hydraulic circuit of the hydraulic excavator 1 according to the first embodiment.

FIG. 5 is a schematic diagram of a hydraulic circuit of the hydraulic excavator 1 according to the present embodiment. The boom cylinder 16, the arm cylinder 17, the bucket cylinder 18, and the swing motor 19 are driven by a hydraulic operating fluid delivered from a main pump 39. The flow rates and circulation directions of the hydraulic operating fluid supplied to the respective hydraulic actuators 16 to 19 are controlled by control valves 35, 36, 37, and 38 operated by driving signals output from the controller 21 according to the operation directions and operation amounts of the control levers 22*a* and 22*b*.

The control levers 22*a* and 22*b* generate operation signals according to the operation directions and operation amounts of the control levers 22*a* and 22*b*, and output the operation signals to the controller 21. The controller 21 generates driving signals (electric signals) corresponding to the operation signals, and outputs the driving signals to the control valves 35 to 38 as solenoid proportional valves. The controller 21 thereby operates the control valves 35 to 38.

The operation directions of the control levers 22*a* and 22*b* define the operation directions of the hydraulic actuators 16 to 19. When the control lever 22*a* is operated in a forward direction, a spool of the control valve 35 controlling the boom cylinder 16 moves to a left side in FIG. 5, and supplies the hydraulic operating fluid to the rod side of the boom cylinder 16. When the control lever 22*a* is operated in a rearward direction, the spool of the control valve 35 moves to a right side in the figure, and supplies the hydraulic operating fluid to the bottom side of the boom cylinder 16. When the control lever 22*b* is operated in the forward direction, a spool of the control valve 36 controlling the arm cylinder 17 moves to the left side in the figure, and supplies the hydraulic operating fluid to the rod side of the arm cylinder 17. When the control lever 22*b* is operated in the rearward direction, the spool of the control valve 36 moves to the right side in the figure, and supplies the hydraulic operating fluid to the bottom side of the arm cylinder 17. When the control lever 22*a* is operated in a left direction, a spool of the control valve 37 controlling the bucket cylinder 18 moves to the right side in the figure, and supplies the hydraulic operating fluid to the bottom side of the bucket cylinder 18. When the control lever 22*a* is operated in a right direction, the spool of the control valve 37 moves to the left side in the figure, and supplies the hydraulic operating fluid to the rod side of the bucket cylinder 18. When the control lever 22*b* is operated in the left direction, a spool of the control valve 38 controlling the swing motor 19 moves to the left side in the figure, and supplies the hydraulic operating fluid to the swing motor 19 from the left side in the figure. When the control lever 22*b* is operated in the right direction, the spool of the control valve 38 moves to the right side in the figure, and supplies the hydraulic operating fluid to the swing motor 19 from the right side in the figure.

In addition, the valve opening degrees of the control valves 35 to 38 change according to the operation amounts of the corresponding control levers 22*a* and 22*b*. That is, the operation amounts of the control levers 22*a* and 22*b* define the operation speeds of the hydraulic actuators 16 to 19. For example, when operation amounts in a certain direction of the control levers 22*a* and 22*b* are increased, the valve opening degrees of the control valves 35 to 38 corresponding to the direction increase, the flow rates of the hydraulic operating fluid supplied to the hydraulic actuators 16 to 19 increase, and thereby the speeds of the hydraulic actuators 16 to 19 increase. Thus, the operation signals generated by the control levers 22*a* and 22*b* have an aspect of speed commands to the target hydraulic actuators 16 to 19. Accordingly, in the present document, the operation signals generated by the control levers 22*a* and 22*b* may be referred to as speed commands to the hydraulic actuators 16 to 19 (control valves 35 to 38).

The pressure of the hydraulic operating fluid delivered from the main pump 39 (hydraulic operating fluid pressure) is adjusted so as not to be excessive by a relief valve 40 that communicates with a hydraulic operating fluid reservoir 41 under a relief pressure. The return flow passages of the control valves 35 to 38 communicate with the hydraulic operating fluid reservoir 41 such that the hydraulic fluid supplied to the hydraulic actuators 16 to 19 returns to the hydraulic operating fluid reservoir 41 again via the control valves 35 to 38.

The controller 21 is configured to be supplied with signals of the boom angle sensor 24, the arm angle sensor 25, the bucket angle sensor 26, the swing angular velocity sensor 27, and the inclination angle sensor 28, the boom bottom pressure sensor 29 and the boom rod pressure sensor 30 attached to the boom cylinder 16, and the arm bottom pressure sensor 31 and the arm rod pressure sensor 32 attached to the arm cylinder 17. The controller 21 is configured to calculate the load value (transport load) of a transportation object being transported by the front work device 12 on the basis of these sensor signals, and display a resulting load measurement result on the monitor 23.

—System Configuration—

Figure 6:
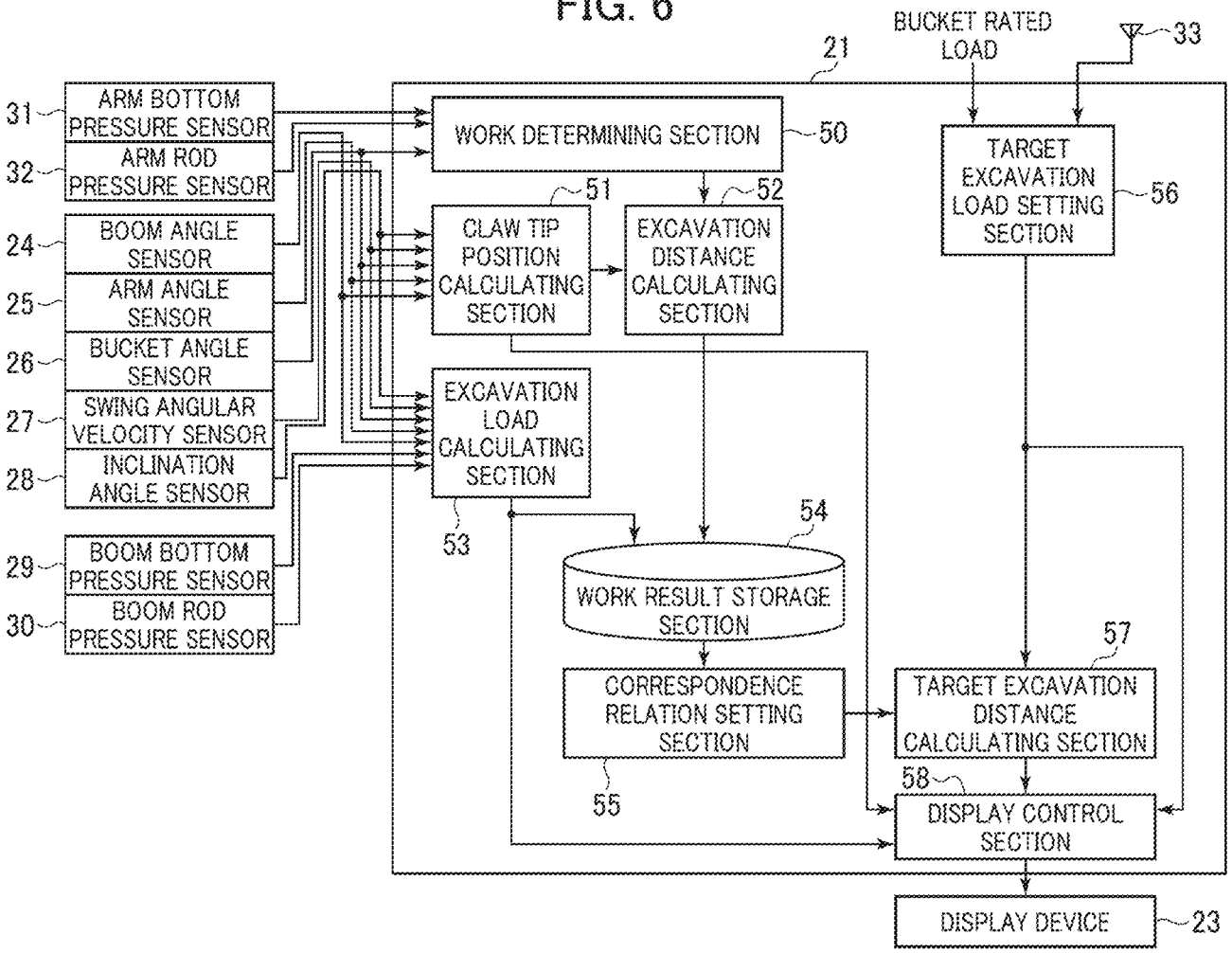
FIG. 6 is a system configuration diagram of an excavation loading work guidance system included in the hydraulic excavator 1 according to the first embodiment.

FIG. 6 is a system configuration diagram of the excavation and loading work guidance system included in the hydraulic excavator 1 according to the present embodiment. The excavation and loading work guidance system according to the present embodiment is implemented within the controller 21 as a combination of a few pieces of software, and is configured to be supplied with signals of the sensors 24 to 32 and the communication antenna 33, perform processing of calculating the load value of the transportation object and an integrated value of the load value and the like within the controller 21, and display a result of the processing on the monitor 23 as required.

Within the controller 21 in FIG. 6, functions possessed by the controller 21 are illustrated in a block diagram. The controller 21 includes: a work determining section 50 that determines work being performed by the front work device 12 on the basis of at least one of the posture information of the front work device 12 which posture information is obtained from the output of the sensors 24 to 28 and the load information of a hydraulic actuator which load information is obtained from the output of the sensors 31 and 32; a claw tip position calculating section (control point position calculating section) 51 that calculates the claw tip position of the bucket 15 (position of the control point) in the machine body coordinate system set to the upper swing structure 11, for example, on the basis of the posture information of the front work device 12 which posture information is obtained from the output of the sensors 24 to 28; an excavation distance calculating section 52 that calculates an excavation distance on the basis of a determination result of the work determining section 50 and the bucket claw tip position of the claw tip position calculating section 51; an excavation load calculating section 53 that calculates an excavation load as the load value of the excavation target object within the bucket which excavation target object is excavated by the front work device 12 on the basis of the output of the sensors 24 to 30; a work result storage section 54 that stores the excavation load calculated by the excavation load calculating section 53 and the excavation distance calculated by the excavation distance calculating section 52 in actual excavation work in association with each other; a correspondence relation setting section 55 that sets a correspondence relation between a target excavation load as a target value of the excavation load and a target excavation distance as a target value of the excavation distance on the basis of a tendency of a correspondence relation between the excavation load and the excavation distance stored in the work result storage section 54; a target excavation load setting section 56 that sets the target excavation load on the basis of rated capacity information of the bucket 15; a target excavation distance calculating section 57 that calculates the target excavation distance on the basis of the correspondence relation set by the correspondence relation setting section 55 and the target excavation load set by the target excavation load setting section 56; and a display control section 58 that generates information to be displayed on the monitor 23 on the basis of the output of the claw tip position calculating section 51, the excavation load calculating section 53, the target excavation load setting section 56, and the target excavation distance calculating section 57. Incidentally, the information stored in the work result storage section 54 is stored in a storage device within the controller 21, and the calculation processing performed by the other parts is performed by a calculation processing device within the controller 21.

When the work determining section 50 determines that excavation work by the front work device 12 is started, the excavation distance calculating section 52 is supplied with the bucket claw tip position at the time from the claw tip position calculating section 51, regarding the bucket claw tip position at the time as the excavation start position. Using the input bucket claw tip position, the excavation distance calculating section 52 calculates the horizontal excavation start distance (excavation distance) D1 as the horizontal distance from the swing center of the upper swing structure 11 to the bucket claw tip position as an excavation distance.

Figure 8:
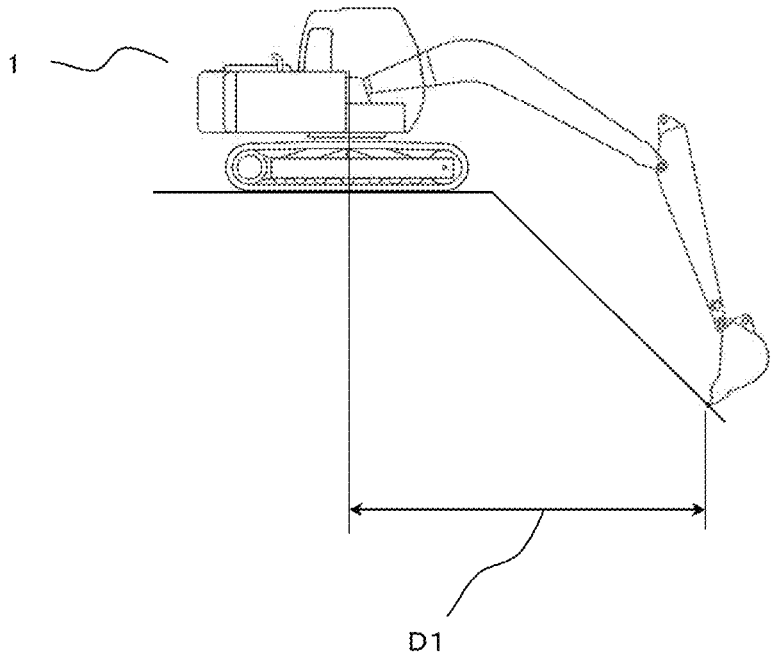
FIG. 8 illustrates an example of a data format defining correspondence relation between the excavation load and the excavation distance (D1) stored in a work result storage section 54.

A data format stored by the work result storage section 54 will be described. FIG. 8 illustrates an example of a data format defining the correspondence relation between the excavation load and the excavation distance (D1) stored in the work result storage section 54. (a) in FIG. 8 illustrates the excavation distance D1 calculated by the excavation distance calculating section 52 according to the present embodiment in a situation in which the hydraulic excavator 1 performs excavation work. In addition, (b) in the figure illustrates a data form in which the excavation load and the excavation distance D1 are stored in a pair in the work result storage section 54. In the present embodiment, each piece of excavation work is identified by an excavation ID, as illustrated in a table of (b), and the excavation load and the excavation distance calculated in each piece of excavation work are stored in the work result storage section 54 as one set of numerical values.

The correspondence relation setting section 55 according to the present embodiment sets the correspondence relation between the target excavation distance and the target excavation load by performing regression analysis of data of a plurality of sets of the excavation distance D1 and the excavation load stored in the work result storage section 54. An arbitrary function excellently approximating the data of the work result storage section 54 can be selected as a function (regression equation) defining the correspondence relation between the target excavation distance and the target excavation load. In the present embodiment, the correspondence relation between the target excavation distance and the target excavation load is set by a linear least-square method (see a graph of (a) in FIG. 9). Specifically, the correspondence relation between the target excavation load W and the target excavation distance D is set by using a linear expression (D=mW+b (where m and b are coefficients determined from the data of the work result storage section 54)). Next, referring to FIG. 9, description will be made of a concrete example of setting the correspondence relation between the target excavation load and the target excavation distance by the correspondence relation setting section 55, including the setting of the correspondence relation by a linear least-square method.

Figure 9:
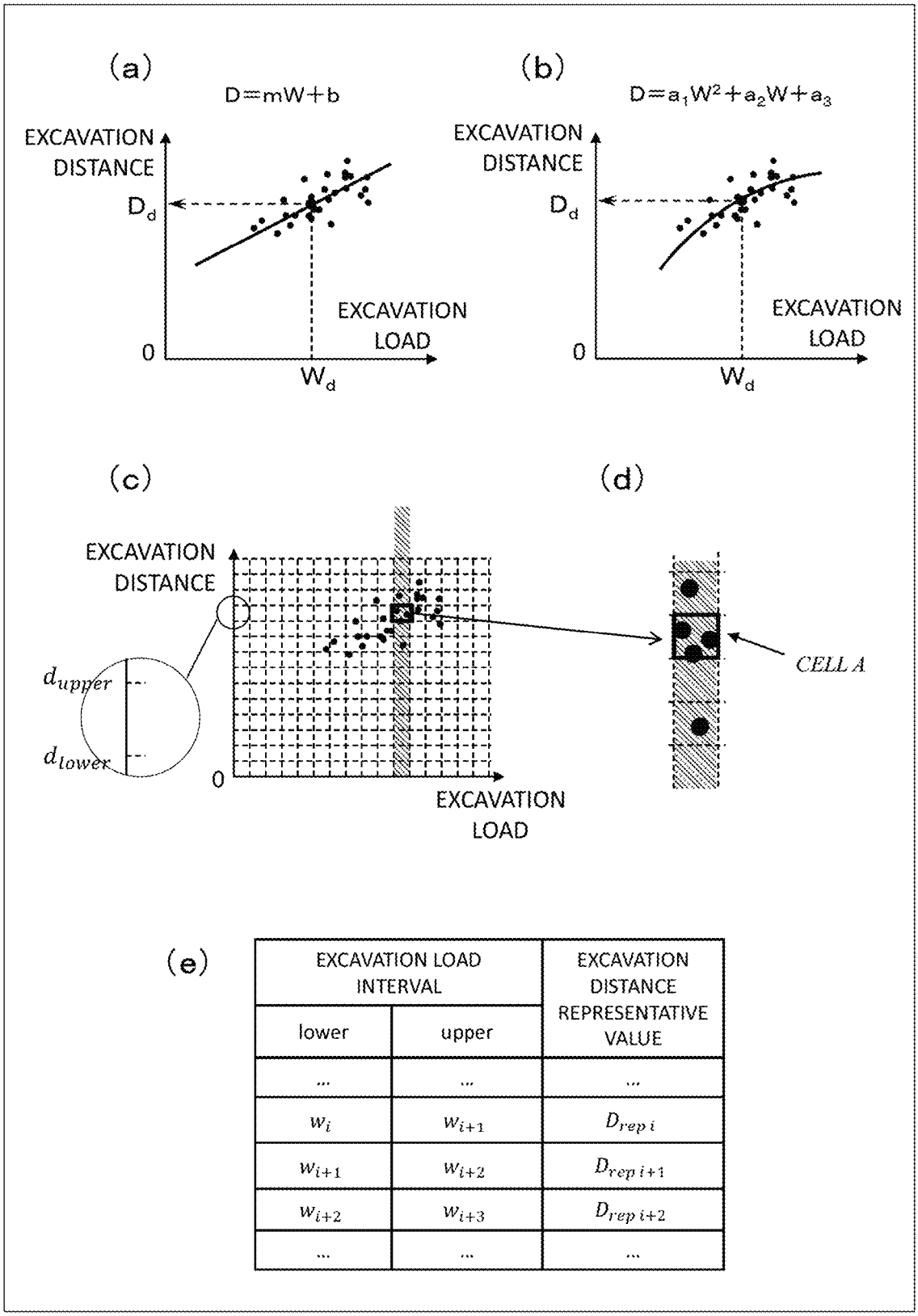
FIG. 9 is a graph illustrating an example of relation between a target excavation load and a target excavation distance which relation is set by a correspondence relation setting section 55.

FIG. 9 is a graph illustrating an example of relation between the target excavation load and the target excavation distance which relation is set by the correspondence relation setting section 55. A graph of (a) in FIG. 9 is a graph illustrating the relation between the target excavation load and the target excavation distance which relation is set from a linear least-square method. A graph of (b) is a graph illustrating the relation between the target excavation load and the target excavation distance which relation is set from a quadratic least-square method. The correspondence relation setting section 55 can set the correspondence relation between the target excavation load and the target excavation distance by determining the values of respective coefficients (m, b, $a_1$, $a_2$, and $a_3$) of an approximate straight line (D=mW+b) or an approximate curve ($D=a_1 W^2+a_2 W+a_3$) in the graph of (a) or (b) on the basis of the information stored in the work result storage section 54. When the correspondence relation setting section 55 in the present embodiment sets the approximate straight line (D=mW+b) of FIG. 9(*a*), for example, the target excavation distance calculating section 57 can input the target excavation load $W_d$ to the equation of the approximate straight line, and calculate the value of the excavation distance $D_d$ ($D_d=mW_d+b$) at the time as the target excavation distance.

FIGS. 9(*c*) to 9(*e*) are diagrams of assistance in explaining an example of setting the correspondence relation between the target excavation distance and the target excavation load by storing the information stored in the work result storage section 54 into each cell of a grid (see FIG. 9(*c*)) formed by dividing each of the excavation load and the excavation distance at equal intervals. The correspondence relation setting section 55 counts the number of data sets of the excavation load and the excavation distance stored in each cell of the grid of (c), and determines a cell A (see (d)) including most data in each excavation load interval. Then, a representative value $D_{rep}$ of the excavation distance in the cell A including the most data in each excavation load interval is calculated. The representative value $D_{rep}$ can be set to be, for example, an intermediate value $D_{rep}=(d_{upper}+d_{lower})/2$ in a corresponding excavation distance interval (where $d_{upper}$ is a maximum value of the corresponding excavation distance interval, and $d_{lower}$ is a minimum value of the corresponding excavation distance interval). In addition, the representative value $D_{rep}$ can also be set to be an average value $D_{rep}$=mean ($d|d\in A$) of the excavation distance d in the data sets included within the corresponding cell A, or a median value $D_{rep}$=median ($d|d\in A$) of the excavation distance d in the data sets included within the corresponding cell A. Then, as illustrated in (e), the correspondence relation between the target excavation distance and the target excavation load is set by the cell A of each excavation load interval and the representative value $D_{rep}$ of the excavation distance in the cell A. The target excavation distance calculating section 57 calculates the target excavation distance from the target excavation load on the basis of the relation set by the correspondence relation setting section 55. For example, when the input target excavation load W corresponds to an excavation load interval $w_i \leq W < w_{i+1}$ illustrated in a second row of (e), an excavation distance representative value $D_{rep}$ in the row is output as the target excavation distance.

Incidentally, the correspondence relation setting section 55 may determine whether or not a sufficient number of data sets to set the correspondence relation between the target excavation distance and the target excavation load are stored in the work result storage section 54. As a method for this determination, there is a method of setting, in advance, a threshold value for the number of data sets stored in the work result storage section 54, and outputting an error code to the target excavation distance calculating section 57 to be described later instead of setting the correspondence relation when the number of data sets in the work result storage section 54 is less than the threshold value.

The target excavation load setting section 56 cannot only set the target excavation load from the rated capacity information of the bucket 15 but also receive the load value (weight) of the excavation target object that can be additionally loaded onto the transporting machine (dump truck) 2 from a controller of the transporting machine 2 or the like by using the communication antenna 33, for example, and set the target excavation load on the basis of the received load value and the load value of the excavation target object which load value is calculated from the rated capacity of the bucket 15 (the load value calculated from the rated capacity of the bucket 15 may hereinafter be referred to as a "rated load"). When the load value that can be loaded onto the transporting machine 2 exceeds the rated load of the bucket 15, the rated load of the bucket 15 can be set as the target load.

Next, referring to FIGS. 7 to 12, description will be made of a method by which the excavation and loading work guidance system of the work machine according to the present embodiment calculates the excavation distance and the excavation load, stores the excavation distance and the excavation load in association with each other, sets the relation between the target excavation distance and the target excavation load on the basis of the stored information, calculates the target excavation distance on the basis of the relation and the target excavation load, and notifies the target excavation distance to the operator.

Figure 7:
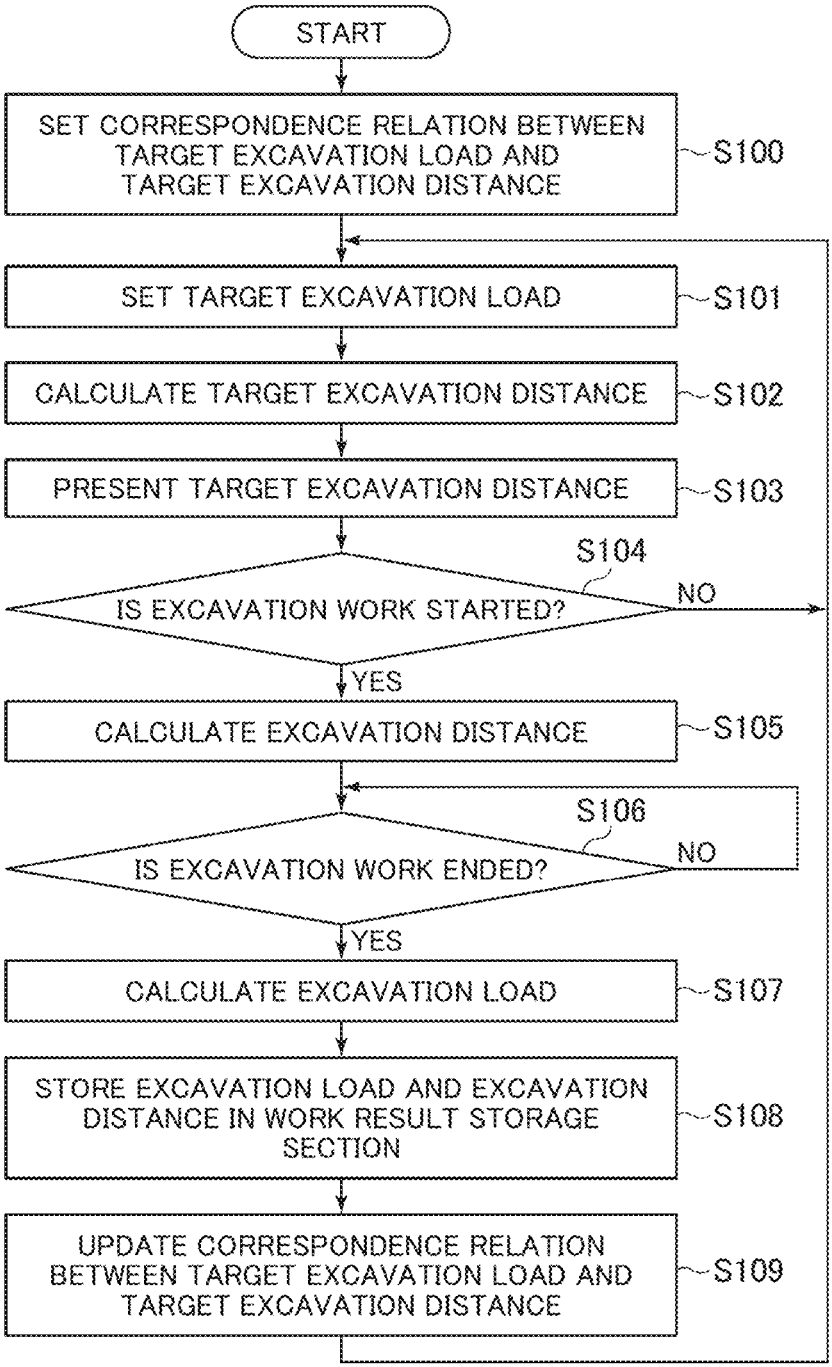
FIG. 7 is a flowchart of processing performed by a controller 21 according to the first embodiment.

FIG. 7 is a flowchart of processing performed by the controller 21 according to the first embodiment. The controller 21 starts the processing of FIG. 7 when power to the controller 21 is turned on.

In step S100, the controller 21 reads the information stored in the work result storage section 54, and sets the relation between the target excavation load and the target excavation distance by the correspondence relation setting section 55. The correspondence relation setting section 55 according to the present embodiment sets the relation between the target excavation load and the target excavation distance by the linear expression (D=mW+b) illustrated in FIG. 9(*a*). The coefficients m and b in the linear equation are determined from the information stored in the work result storage section 54.

In step S101, the controller 21 receives information of a loadable load value from the transporting machine 2 by using the communication antenna 33, and sets the target excavation load in the target excavation load setting section 56 on the basis of the received information and the preset rated capacity information of the bucket 15. It is difficult for the hydraulic excavator 1 to load an excavation exceeding the rated load of the bucket 15. Thus, when the loadable load value of the transporting machine 2 exceeds the rated load of the bucket 15, the rated load of the bucket 15 is set as the target load. When the received loadable load value of the transporting machine 2 does not exceed the rated load of the bucket 15, the loadable load value of the transporting machine 2 is set as the target excavation load.

In step S102, the target excavation distance is calculated by using the target excavation distance calculating section 57 using the set target excavation load and the relation set by the correspondence relation setting section 55. For example, when the correspondence relation setting section 55 sets D=mW+b as the relation, and the target excavation load setting section 56 sets $W_d$ as the target excavation load, the target excavation distance calculating section 57 calculates $D_d=mW_d+b$ as the target excavation distance $D_d$, as illustrated in FIG. 9(*a*).

In addition, when an error code is input as the set relation, the target excavation distance calculating section 57 outputs the error code to the display control section 58 to be described later in place of the target excavation distance.

In step S103, the display control section 58 presents the target excavation distance calculated in step S102 to the operator through the monitor 23. An example of the display screen of the monitor 23 is illustrated in FIG. 10.

Figure 10:
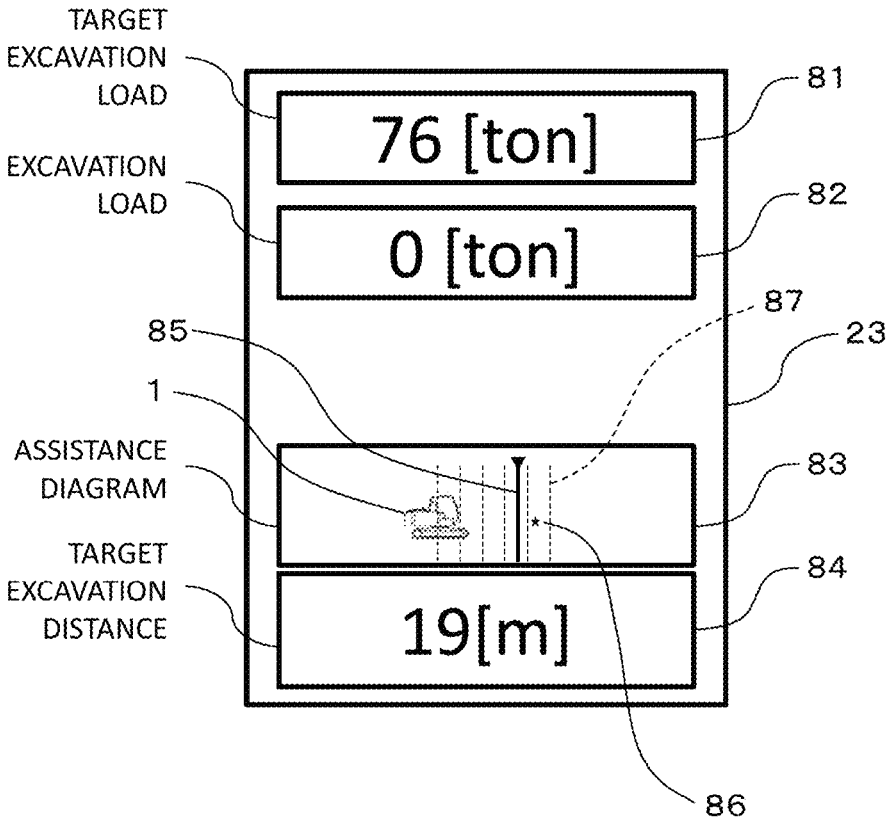
FIG. 10 is a diagram illustrating an example of the display screen of a monitor 23.

The display screen of FIG. 10 includes: a target excavation load display section 81 that displays the numerical value of the target excavation load calculated in step S101; an excavation load display section 82 that displays the numerical value of an excavation load calculated in step S107; an assistance diagram display section 83 that displays a positional relation between the excavation start position of the target excavation distance calculated in step S102 and the bucket 15; and a target excavation distance display section 84 that displays the numerical value of the target excavation distance calculated in step S102.

The assistance diagram display section 83 displays: a simplified diagram of the lower track structure 10 and the upper swing structure 11 of the hydraulic excavator 1; a plurality of auxiliary lines 87 arranged at fixed intervals in the front-rear direction of the machine body; a straight line 85 passing through the excavation start position separated from the swing center (reference point) of the upper swing structure 11 by the target excavation distance D1; and a dot 86 that indicates the claw tip position of the bucket 15 which claw tip position is calculated by the claw tip position calculating section 51. This assistance diagram enables even an operator lacking in skill and experience to easily grasp the target excavation distance (excavation start position) from an operation seat and the present bucket claw tip position with respect to the target excavation distance (excavation start position).

In addition, when an error code is output as a result of the calculation of the target excavation distance in step S102, the display control section 58 displays an error message that, for example, "information is insufficient. Please perform excavation and loading work for a while to collect information" in the target excavation distance display section 84, and does not display the line 85 indicating the excavation start position in the assistance diagram.

In step S104, whether or not the hydraulic excavator 1 has started excavation work is determined by using the work determining section 50. The work determining section 50 calculates a thrust $F_{amcyl}$ of the arm cylinder 17 on the basis of the output of the pressure sensors 31 and 32 for the bottom pressure and rod pressure of the arm, and calculates the value of a bucket angle as an angle formed between the bucket 15 and the arm 14 from the output of the bucket angle sensor 26. The work determining section 50 determines whether or not the hydraulic excavator 1 is performing excavation work on the basis of the calculated thrust $F_{amcyl}$ of the arm cylinder 17 and the value of the bucket angle.

Letting $P_1$ and $P_2$ be pressure values calculated from the signals of the arm bottom pressure sensor 31 and the arm rod pressure sensor 32, and letting $A_1$ and $A_2$ be respective pressure receiving areas, the thrust $F_{amcyl}$ of the arm cylinder 17 is obtained from Equation (1).

$$F_{amcyl}=A_1 \cdot P_1-A_2 \cdot P_2 \quad (1)$$

Figure 11:
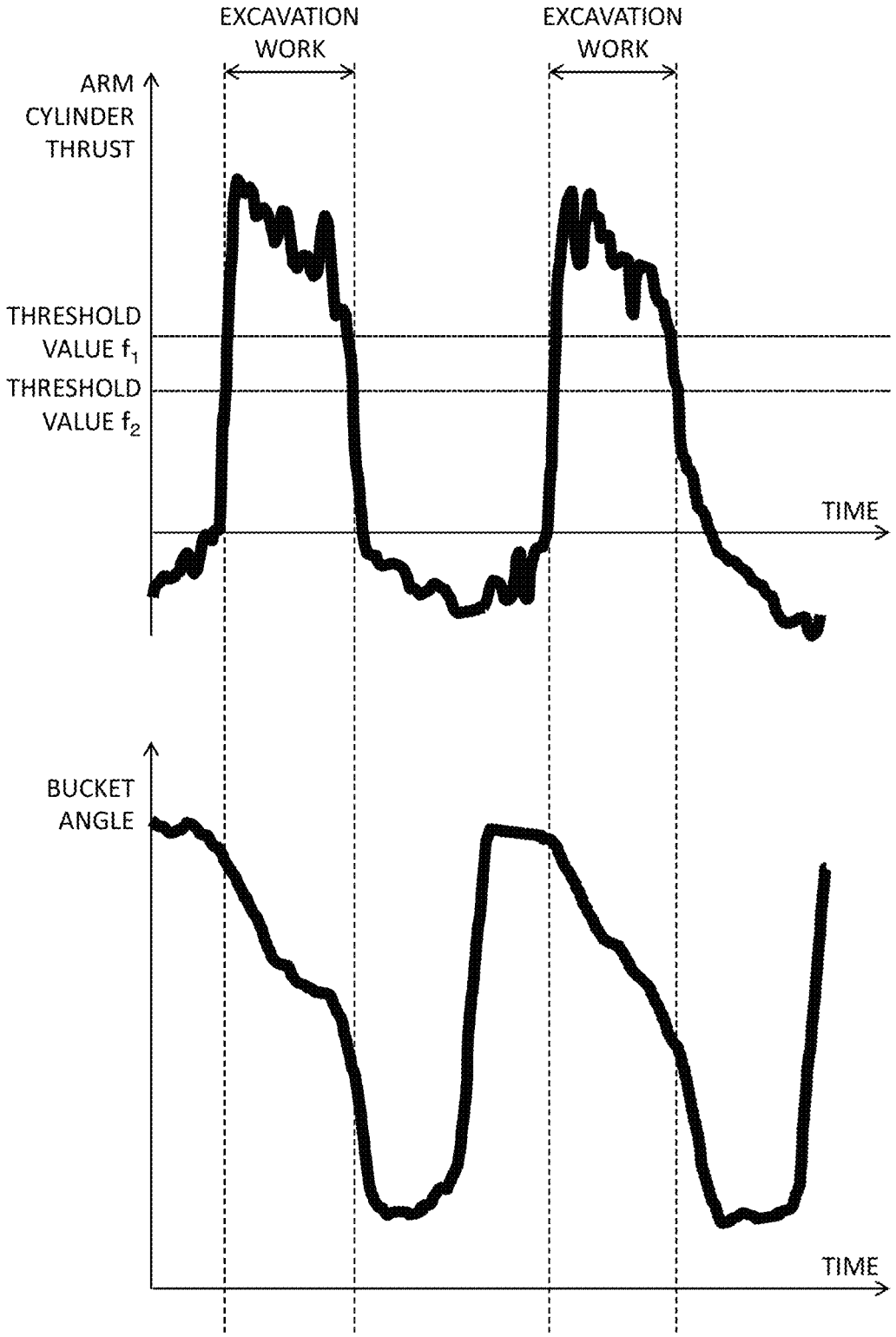
FIG. 11 is a diagram of assistance in explaining a method of determining excavation work from an arm cylinder thrust and a bucket angle.

As illustrated in FIG. 11, the work determining section 50 in the present embodiment determines that excavation work is started when the thrust $F_{amcyl}$ of the arm cylinder 17 exceeds a threshold value $f_1$ set in advance, and at the same time the bucket angle is decreasing. In the present embodiment, a start of excavation is determined by using the cylinder thrust and the bucket angle. However, there is no limitation to this. The determination can be made by using one of the cylinder thrust and the bucket angle. When excavation work is started, the processing is advanced to step S105. When excavation work is not started, the processing returns to step S101 to repeat steps S101 to S104 again.

In step S105, the controller 21 calculates the excavation distance D1 by using the excavation distance calculating section 52. The excavation distance D1 in the present embodiment is a horizontal distance from the swing center of the upper swing structure 11 to the bucket claw tip position when the excavation work is started. Accordingly, the present embodiment considers that the bucket claw tip is present at the excavation start position at a point in time of determination in step S104 that the excavation work is started, and calculates the bucket claw tip position by using the excavation distance calculating section 52, so as to be triggered by the determination in step S104 that the excavation work is started. Then, the value of the excavation distance D1 is calculated by calculating the horizontal distance between the bucket claw tip position calculated at this time and the swing center. The claw tip position of the bucket 15 at the time of the start of the excavation work can be calculated easily when dimensions of the hydraulic excavator 1 which dimensions are set in advance and signals of the sensors 24 to 29, 31, and 32 are used. The dimensions of the hydraulic excavator 1 used for this calculation include, for example, a distance from a boom rotational axis to an arm rotational axis in the operation plane of the front work device 12, a distance from the arm rotational axis to a bucket rotational axis in the same plane, a distance from the bucket rotational axis to a bucket front end in the same plane, and a distance from the origin of the machine body coordinate system to the boom rotational axis in the same plane.

In step S106, the controller 21 determines whether or not the hydraulic excavator 1 has ended the excavation work by using the work determining section 50. The work determining section 50 in the present embodiment determines that the excavation work is ended when the thrust $F_{amcyl}$ of the arm cylinder 17 becomes less than a threshold value $f_2$ set in advance after the hydraulic excavator 1 started the excavation work. Step S106 is repeated until the excavation work of the hydraulic excavator 1 is ended. When it is determined that the excavation work is ended, the processing is advanced to step S107.

Figure 12:
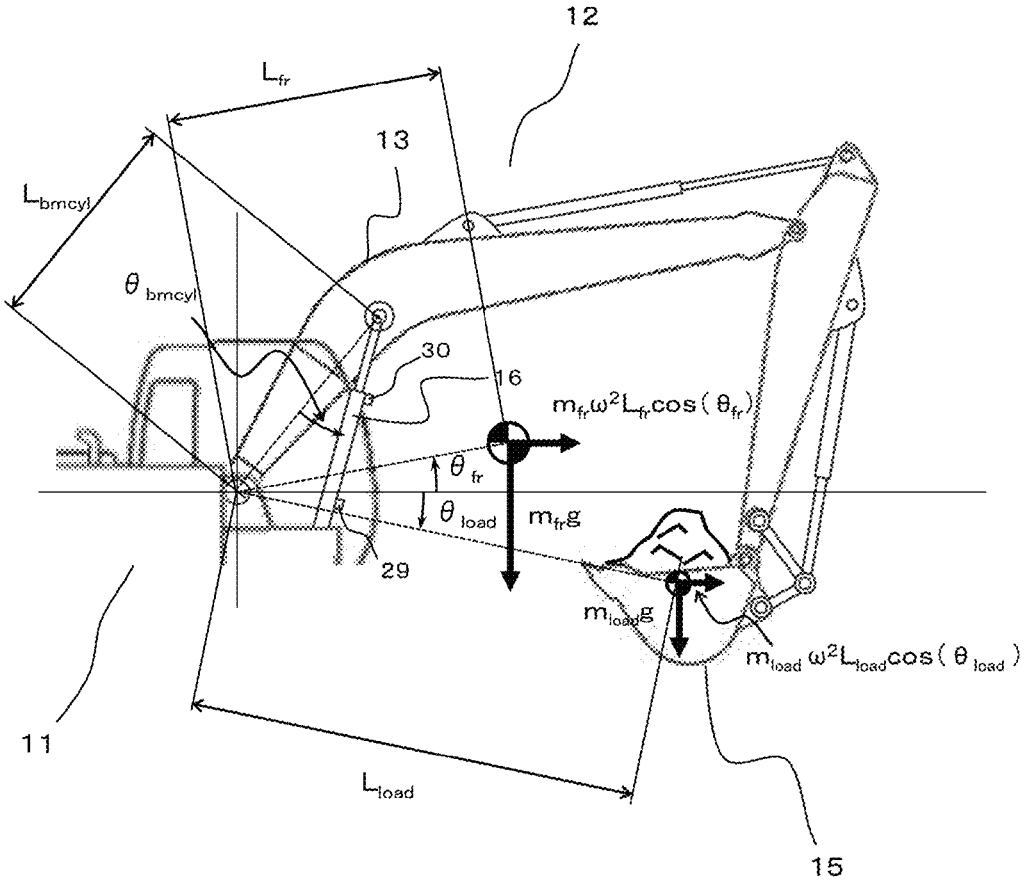
FIG. 12 is a diagram of assistance in explaining a method of calculating the load value of an excavation target object within a bucket 15 by an excavation load calculating section 53 in the controller 21.

In step S107, the controller 21 calculates the excavation load as the load value (weight) of the excavation target object included in the bucket 15 by using the excavation load calculating section 53. FIG. 12 is a diagram of assistance in explaining a method of calculating the load value of the excavation target object within the bucket 15 by the excavation load calculating section 53 in the controller 21. As illustrated in this figure, the excavation load can be calculated on the basis of a balance of torques around the rotational axis of the boom 13 of the hydraulic excavator 1 by using the dimensions and weight of the hydraulic excavator 1 and signal values of the sensors 24 to 30. The present embodiment calculates the excavation load during swing boom raising (that is, while swing operation of the upper swing structure 11 and extending operation of the boom cylinder 16 are performed) performed in transporting work after the excavation work from a viewpoint of improving a degree of accuracy of the calculated load. However, the excavation load may be calculated in another situation. Incidentally, whether or not the hydraulic excavator 1 is engaged in the transporting work can be determined by the work determining section 50.

The torques acting around the rotational axis of the boom 13 include a torque $\tau_{bmcyl}$ generated by the thrust of the boom cylinder 16, a torque $\tau_{frg}$ generated by gravity acting on the center of gravity of the front work device 12, a torque $\tau_{frc}$ generated at the center of gravity of the front work device 12 by a centrifugal force generated by a swing of the upper swing structure 11, a torque $\tau_{loadg}$ generated by gravity acting on the center of gravity of the excavation target object included in the bucket 15, and a torque $\tau_{loadc}$ generated at the center of gravity of the excavation target object included in the bucket 15 by a centrifugal force generated by the swing of the upper swing structure 11.

The torque $\tau_{bmcyl}$ generated by a thrust $F_{bmcyl}$ of the boom cylinder 16 around the rotational axis of the boom 13 is obtained from Equation (2) using the thrust $F_{bmcyl}$, to be described later, of the boom cylinder 16, a length $L_{bmcyl}$ of a straight line connecting the rotational axis of the boom 13 to the center of a connecting portion connecting the boom cylinder 16 to the boom, and an angle $\theta_{bmcyl}$ formed between the straight line and the boom cylinder 16.

$$\tau_{bmcyl}=F_{bmcyl}\cdot L_{bmcyl}\cdot\sin(\theta_{bmcyl}) \tag{2}$$

Letting $P_3$ and $P_4$ be pressures obtained from signals of the boom bottom pressure sensor 29 and the boom rod pressure sensor 30, and letting $A_3$ and $A_4$ be respective pressure receiving areas, the thrust $F_{bmcyl}$ of the boom cylinder 16 is obtained from Equation (3).

$$F_{amcyl}=A_3\cdot P_3-A_4\cdot P_4 \tag{3}$$

The torque $\tau_{frg}$ generated by gravity acting on the center of gravity of the front work device 12 around the rotational axis of the boom 13 is obtained by Equation (4) using a length $L_{fr}$ of a straight line connecting the center of rotation of the boom 13 to the center of gravity of the front work device 12 and an angle $\theta_{fr}$ formed between the straight line and a horizontal line.

$$\tau_{frg}=m_{fr}\cdot g\cdot L_{fr}\cdot\cos(\theta_{fr}) \tag{4}$$

The torque $\tau_{frc}$ generated around the rotational axis of the boom 13 by a centrifugal force acting on the front work device 12 when the upper swing structure 11 swings at an angular velocity $\omega$ is obtained by Equation (5).

$$\tau_{frc}==m_{fr}\cdot L_{fr}^2\cdot\omega^2\cdot\sin(\theta_{fr})\cdot\cos(\theta_{fr}) \tag{5}$$

Letting $m_{load}$ be the excavation load as the weight of the excavation target object, letting $L_{load}$ be the length of a straight line connecting the center of rotation of the boom 13 to the center of gravity of the excavation target object included in the bucket 15, and letting $\theta_{load}$ be an angle formed between the straight line and the horizontal line, the torque $\tau_{loadg}$ generated around the rotational axis of the boom 13 by gravity acting on the excavation target object is obtained by Equation (6), and the torque $\tau_{loadc}$ generated around the rotational axis of the boom 13 by a centrifugal force acting on the load is obtained by Equation (7).

$$\tau_{loadg}=m_{load}\cdot g\cdot L_{load}\cdot\cos(\theta_{load}) \tag{6}$$

$$\tau_{loadc}=m_{load}\cdot L_{load}^2\cdot\omega^2\cdot\sin(\theta_{load})\cdot\cos(\theta_{load}) \tag{7}$$

The excavation load $m_{load}$ as the weight of the excavation target object can be calculated by Equation (9) by using Equation (8) of the balance of the torques around the rotational axis of the boom 13.

$$\tau_{bmcyl}+\tau_{loadc}=\tau_{frg}+\tau_{frc}+\tau_{loadg} \tag{8}$$

$$m_{load}=\{F_{bmcyl}\cdot L_{bmcyl}\cdot\sin(\theta_{bmcyl})-m_{fr}\cdot g\cdot L_{fr}\cdot\cos(\theta_{fr})-m_{fr}\cdot L_{fr}^{2}\cdot\omega^{2}\cdot\sin(\theta_{fr})\cdot\cos(\theta_{fr})\}/\{g\cdot L_{load}\cdot\cos(\theta_{load})-L_{load}^{2}\cdot\omega^{2}\cdot\sin(\theta_{load})\cdot\cos(\theta_{load})\} \tag{9}$$

The display control section 58 notifies the thus calculated excavation load $m_{load}$ to the operator via the monitor 23.

In step S108, the excavation distance D1 calculated in step S105 at the time of the start of the excavation work and the excavation load $m_{load}$ calculated in step S107 at the time of the end of the excavation work are set as one set of data, and stored in the work result storage section 54. Specifically, as illustrated in FIG. 8(*b*), the excavation load $m_{load}$ and the excavation distance D1 in the actually performed excavation work are set as a pair, and stored in the work result storage section 54.

In step S109, the controller 21 updates (resets) the correspondence relation between the target excavation load and the target excavation distance by using the correspondence relation setting section 55. The correspondence relation setting section 55 performs processing similar to the processing of setting the correspondence relation between the target excavation load and the target excavation distance which processing is performed in step S100, using the information of the work result storage section 54 including the information of the excavation load and the excavation distance newly added in step S108. In the present embodiment, the correspondence relation between the target excavation load and the target excavation distance is reset by recalculating and updating the values of m and b in the equation D=mW+b.

Advantages Obtained by First Embodiment

In the hydraulic excavator 1 configured as described above, each time the operator of the hydraulic excavator 1 performs excavation work by the front work device 12, the excavation distance and the excavation load at the time of the excavation work are set as one set of data, and stored in the work result storage section 54. Then, when an amount of data necessary to derive the correspondence relation between the excavation distance and the excavation load is stored in the work result storage section 54, the controller 21 sets the correspondence relation between the target excavation load and the target excavation distance on the basis of a tendency of the correspondence relation between the excavation distance and the excavation load which tendency is grasped from the stored data by using the correspondence relation setting section 55. After the correspondence relation is set, the target excavation distance calculating section 57 calculates the target excavation distance corresponding to the target excavation load set by the target excavation load setting section 56 by using the correspondence relation, and information regarding the target excavation distance is displayed on the monitor 23 at the time of the excavation work. Specifically, the present embodiment estimates the correspondence relation between the excavation distance and the excavation load from actual result values of the excavation distance (first excavation distance) and the excavation load, calculates the target excavation distance (target value of the first excavation distance) serving as an index of the bucket claw tip position at the time of a start of the excavation work, from which position the target excavation load can be obtained, on the basis of the correspondence relation, and provides the target excavation distance to the operator of the hydraulic excavator 1 via the monitor 23. Thus, when the operator of the hydraulic excavator 1 refers to the target excavation distance on the monitor 23, the operator can easily move the bucket claw tip to the excavation start position irrespective of skill or experience of the operator, and load the excavation target object having a load value close to that of the target excavation load into the bucket 15 by starting the excavation work with an arm crowding operation from the excavation start position. It is consequently easy to bring the loaded weight of the excavation target object loaded on the dump truck (transporting machine) close to the maximum loading amount of the dump truck. Efficiency of the excavation work and the loading work can therefore be improved.

In the present embodiment, the correspondence relation setting section 55 sets the correspondence relation between the target excavation load and the target excavation distance each time the excavation work is performed. The latest correspondence relation can therefore be used at all times. Thus, even when a work environment changes, the target excavation distance matching the work environment after the change can be calculated immediately.

In the present embodiment, the bucket claw tip position (dot 86) and the excavation start position (straight line 85) are displayed in the assistance diagram display section 83 of the monitor screen. The operator of the hydraulic excavator 1 can easily make the bucket claw tip reach the excavation start position by operating the front work device 12 while viewing the assistance diagram display section 83. Thus, the occurrence of overloading or insufficient loading on the dump truck can be prevented, and loading of an appropriate amount is facilitated.

Incidentally, in the flowchart of FIG. 7, an example is cited in which the correspondence relation between the target excavation load and the target excavation distance is always set in step S100 at a time of a start of the processing. However, the processing of step S100 can be omitted in a case where the setting processing is performed in the past. In addition, in the flowchart of FIG. 7, the correspondence relation between the target excavation load and the target excavation distance is always set in step S109 each time the excavation work is performed. However, a frequency at which step S109 is performed can be changed arbitrarily. For example, step S109 can be omitted when a highly accurate correspondence relation is set.

In addition, in the above description, the target excavation load is set by the target excavation load setting section. However, a numerical value set in advance by being input by the operator of the hydraulic excavator 1 or input by a manager of the hydraulic excavator 1 may be used as the target excavation load.

In addition, while the above description has been made of a case where the horizontal excavation start distance D1 is calculated as the excavation distance, it suffices to perform processing similar to the above-described processing also in a case where the vertical distance (vertical excavation start distance) D3 from the bottom surface of the upper swing structure 11 to the excavation start position is used as the excavation distance.

Second Embodiment

The present embodiment is characterized by calculating an achievement level of an actual excavation distance with respect to the target excavation distance, and displaying the achievement level on the monitor 23.

Figure 13:
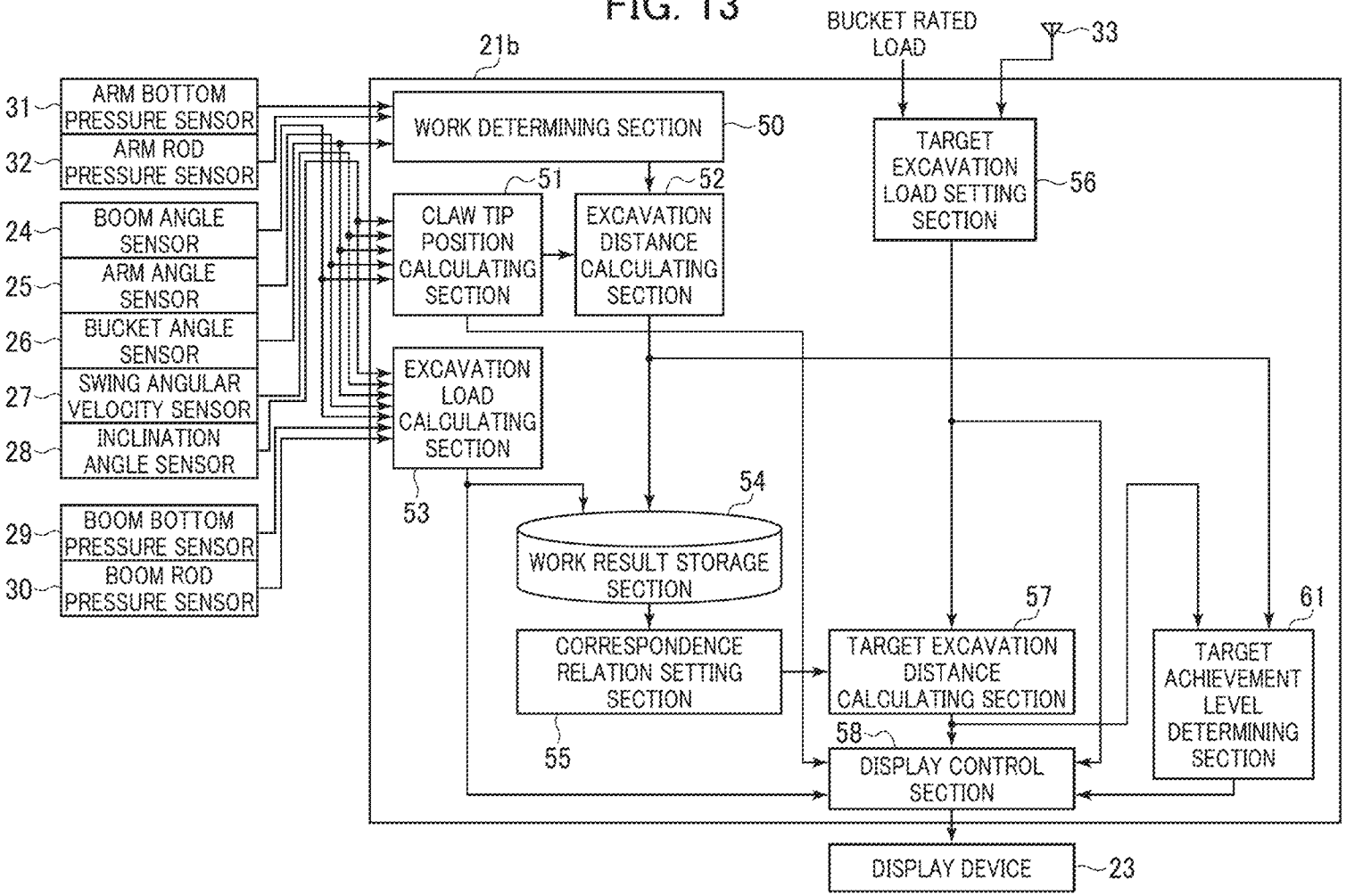
FIG. 13 is a schematic diagram illustrating a system configuration according to a second embodiment.

FIG. 13 is a schematic diagram illustrating a system configuration according to a second embodiment. A controller 21*b* of FIG. 13 has a configuration obtained by adding a target achievement level determining section 61 to the controller 21 in the first embodiment illustrated in FIG. 6. The target achievement level determining section 61 determines an achievement level of the excavation distance with respect to the target excavation distance on the basis of the target excavation distance calculated by the target excavation distance calculating section 57 and the excavation distance calculated by the excavation distance calculating section 52. The target achievement level determining section 61 outputs the achievement level as a result of the determination to the display control section 58. The display control section 58 displays the input achievement level on the monitor 23.

Figure 14:
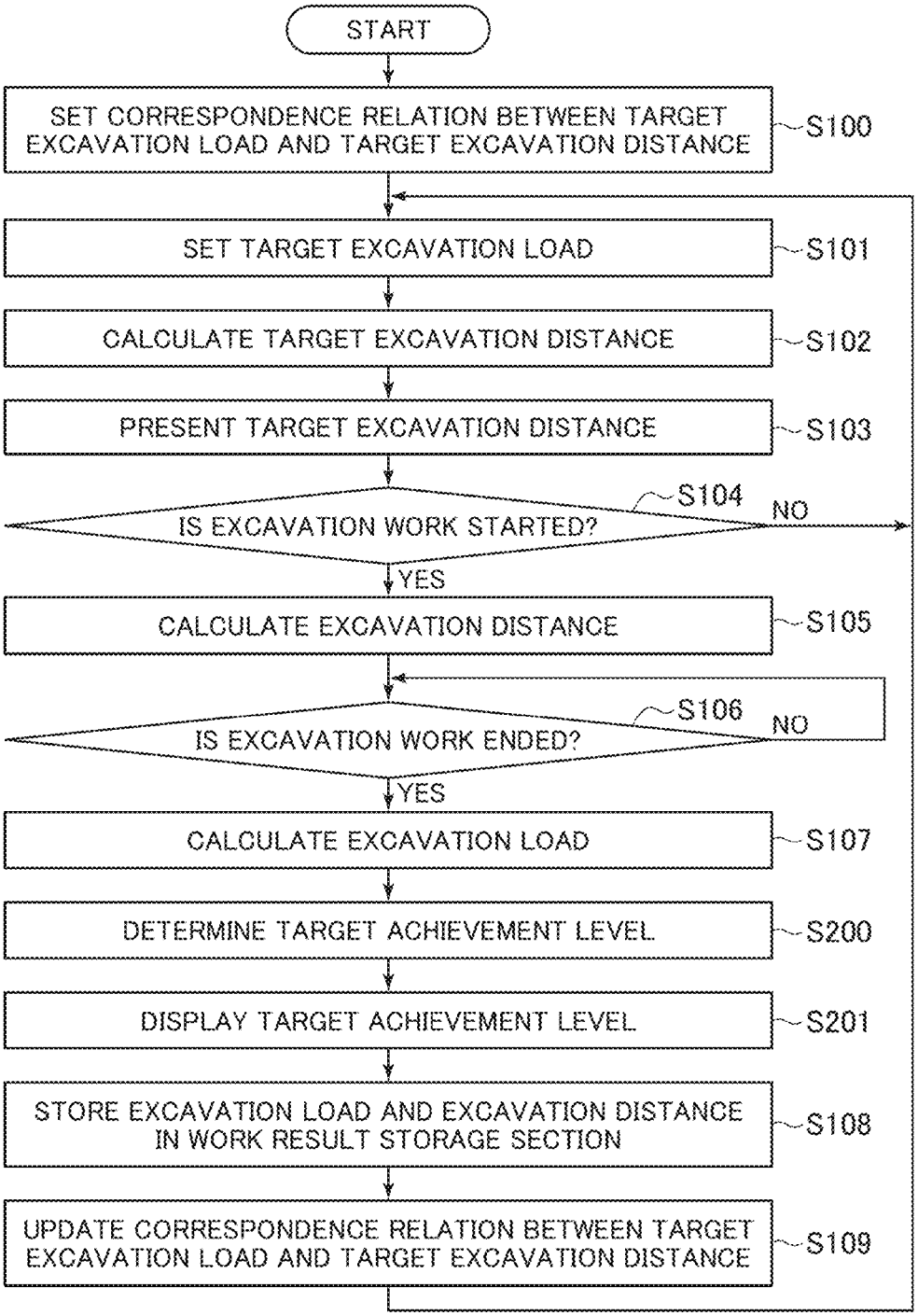
FIG. 14 is a flowchart of processing performed by a controller 21*b* according to the second embodiment.

FIG. 14 is a flowchart of processing performed by the controller 21*b* according to the second embodiment. In FIG. 14, step S200 and step S201 are added to the flowchart of the first embodiment (see FIG. 7).

In step S200, the target achievement level determining section 61 determines a target achievement level by using the target excavation distance and the excavation distance calculated in step S102 and step S105. The target achievement level in the present embodiment is determined as a value indicating the ratio of the excavation distance to the target excavation distance as a percentage.

Figure 15:
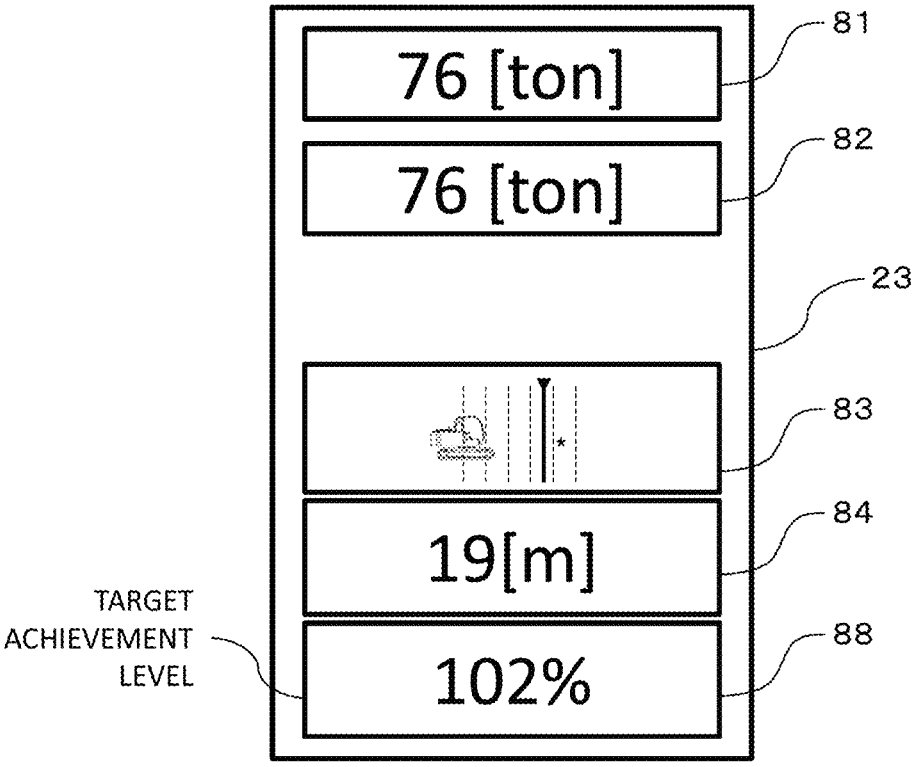
FIG. 15 is a diagram illustrating an example of the display screen of a monitor 23 according to the second embodiment.

In step S201, the display control section 58 presents the target achievement level determined in step S200 to the operator of the hydraulic excavator 1 by displaying the target achievement level on the monitor 23. As illustrated in FIG. 15, a numerical value indicating the target achievement level is displayed in a target achievement level display section 88 provided below the target excavation distance display section 84 on the monitor screen.

Advantages Obtained by Second Embodiment

According to the present embodiment, in addition to the advantages of the first embodiment, the propriety of operation of the front work device 12 by the operator is visualized through the target achievement level. Thus, a further improvement in front implement operation capability of the operator can be expected. As a result, overloading and insufficient loading can be prevented more.

Third Embodiment

The present embodiment is characterized by storing the target excavation distance and an actual excavation distance in association with each other, determining and quantifying a tendency of the actual excavation distance with respect to the target excavation distance by using the stored information, and displaying numerical values (for example, an average value and a variance) related to a result of the determination on the monitor 23.

Figure 16:
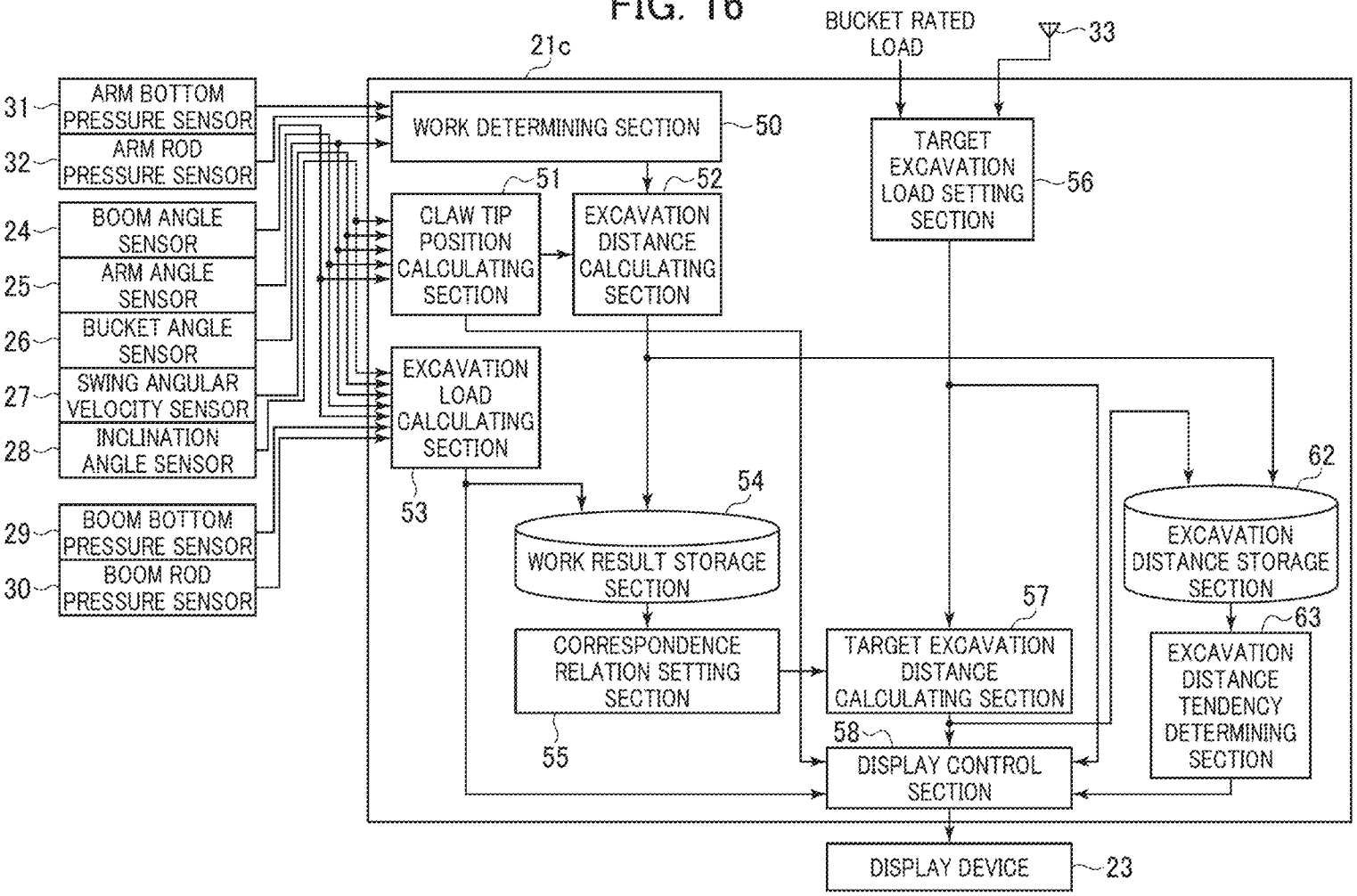
FIG. 16 is a schematic diagram illustrating a system configuration according to a third embodiment.

FIG. 16 is a schematic diagram illustrating a system configuration according to a third embodiment. A controller 21*c* of FIG. 16 is configured by adding, to the controller 21 in the first embodiment illustrated in FIG. 6, an excavation distance storage section 62 that stores the target excavation distance calculated by the target excavation distance calculating section 57 and the excavation distance calculated by the excavation distance calculating section 52 in association with each other and an excavation distance tendency determining section 63 that determines a tendency of the excavation distance with respect to the target excavation distance by using information stored in the excavation distance storage section 62. A determination value of the excavation distance tendency determining section 63 is output to the display control section 58. The display control section 58 displays the determination result of the excavation distance tendency determining section 63 on the monitor 23.

Figure 17:
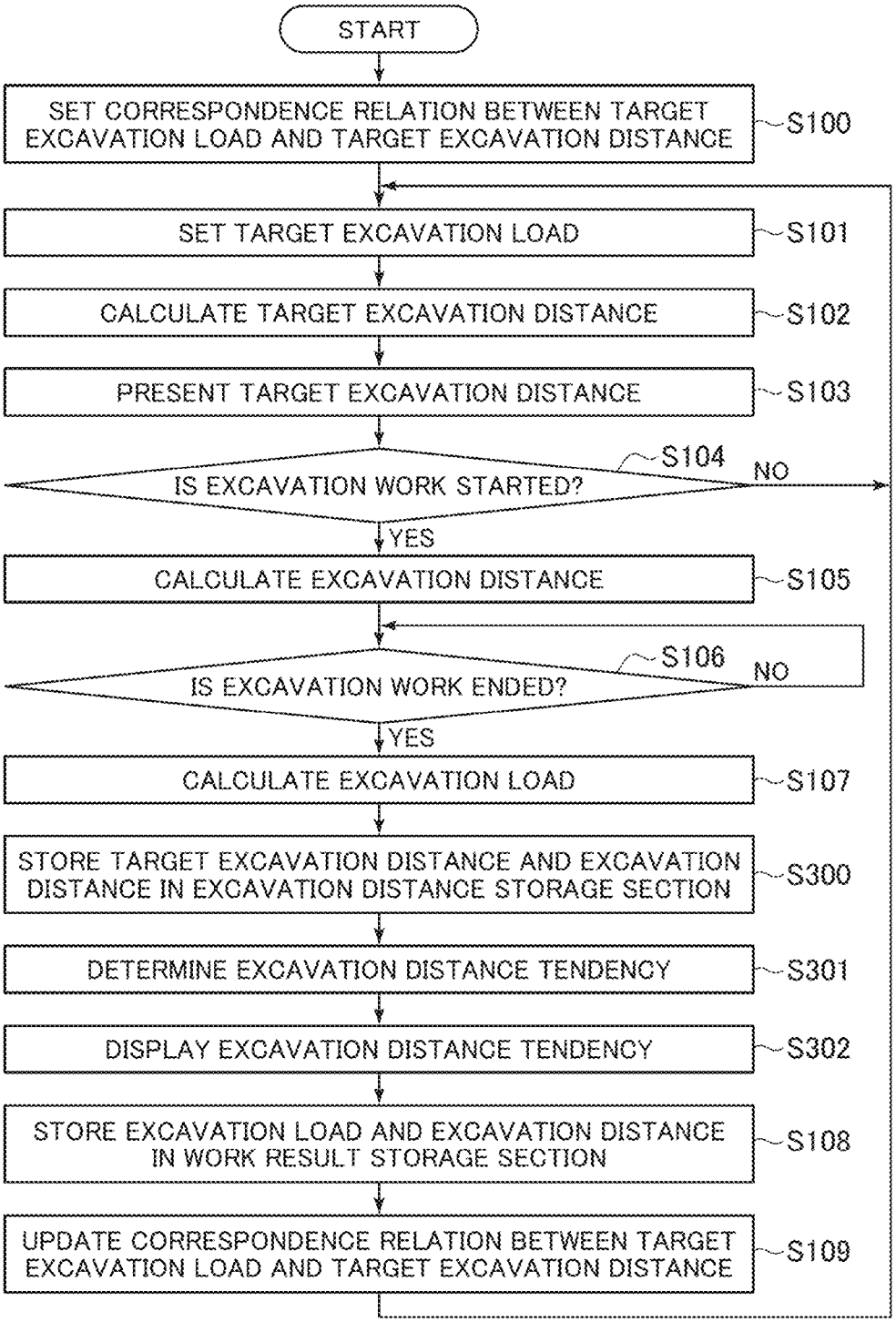
FIG. 17 is a flowchart of processing performed by a controller 21*c* according to the third embodiment.

FIG. 17 is a flowchart of processing performed by the controller 21*c* according to the third embodiment. In FIG. 17, steps S300, S301, and S302 are added to the flowchart of the first embodiment (see FIG. 7).

In step S300, the controller 21*c* stores the target excavation distance calculated in step S102 and the excavation distance calculated in step S105 as one set of data in the excavation distance storage section 62. A form of storage thereof is similar to the form of storage of the excavation load and the excavation distance in the work result storage section 54. The target excavation distance and the excavation distance are stored in a pair.

In step S301, the excavation distance tendency determining section 63 determines a tendency of the excavation distance using the information stored in the excavation distance storage section 62. The tendency determined by the excavation distance tendency determining section 63 is, for example, determined by indicating the ratio of the actual excavation distance to the target excavation distance as a percentage, and using an average value and a variance of the percentage. When the average value exceeds 100%, operation of the front work device 12 by the operator tends to reach a longer excavation distance than the target excavation distance. When the average is less than 100%, the operation of the front work device 12 by the operator tends to reach a shorter excavation distance than the target excavation distance. In addition, the larger a standard deviation is, the more the excavation distance of the operation of the front work device 12 by the operator varies with respect to the target excavation distance.

Figure 18:
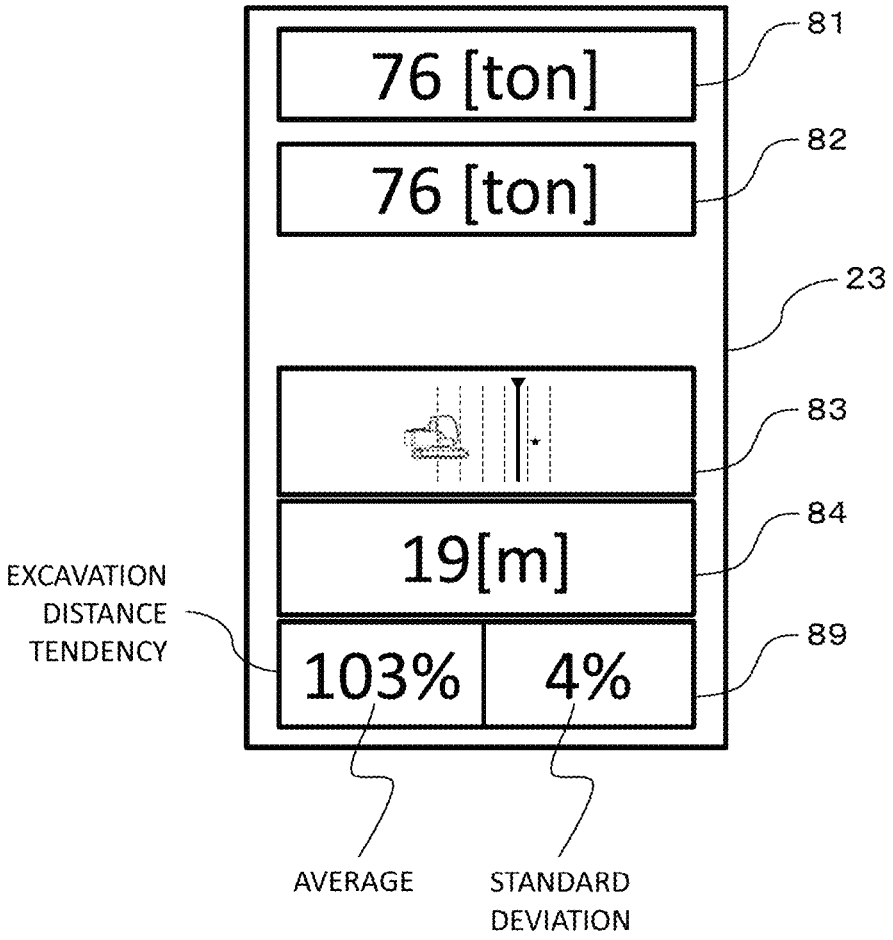
FIG. 18 is a diagram illustrating an example of the display screen of a monitor 23 according to the third embodiment.

In step S302, the display control section 58 presents the values of the average value and the standard deviation calculated in step S301 to the operator by displaying the values of the average value and the standard deviation on the monitor 23. As illustrated in FIG. 18, the values of the average value and the standard deviation are displayed in an excavation distance tendency determination result display section 89 provided below the target excavation distance display section 84 on the monitor screen.

Advantages Obtained by Third Embodiment

According to the present embodiment, in addition to the advantages of the first embodiment, the operator can grasp the tendency of operation of the front work device 12 with respect to the target excavation distance. Thus, when the tendency is utilized to improve the operating method, an improvement in operation of the operator can be expected.

Fourth Embodiment

The present embodiment is characterized by determining whether or not the target excavation load is less than the rated load of the bucket, and displaying the target excavation distance on the monitor screen when it is determined that the target excavation load is less than the rated load of the bucket but not displaying the target excavation distance on the monitor screen when it is determined that the target excavation load is equal to or more than the rated load of the bucket.

Figure 19:
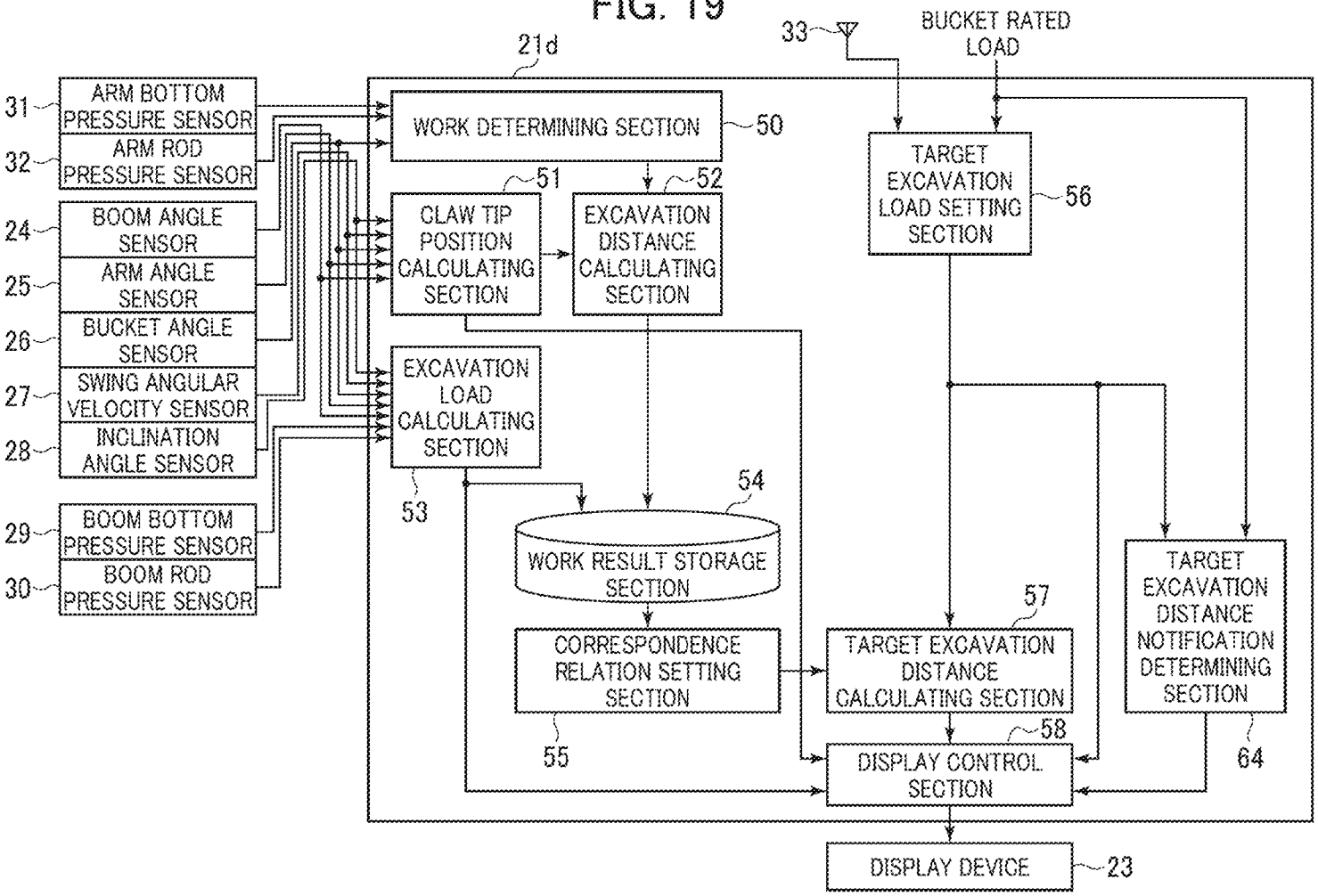
FIG. 19 is a schematic diagram illustrating a system configuration according to a fourth embodiment.

FIG. 19 is a schematic diagram illustrating a system configuration according to a fourth embodiment. A controller 21*d* of FIG. 19 is configured by adding, to the controller 21 in the first embodiment illustrated in FIG. 6, a target excavation distance notification determining section 64 that determines whether or not the target excavation load is less than the rated load of the bucket 15 on the basis of the target excavation load calculated by the target excavation load setting section 56 and the rated capacity information of the bucket 15. A result of the determination of the target excavation distance notification determining section 64 is input to the display control section 58. The target excavation distance is displayed on the monitor 23 when the target excavation distance notification determining section 64 determines that the target excavation load is less than the rated load of the bucket 15.

Figure 20:
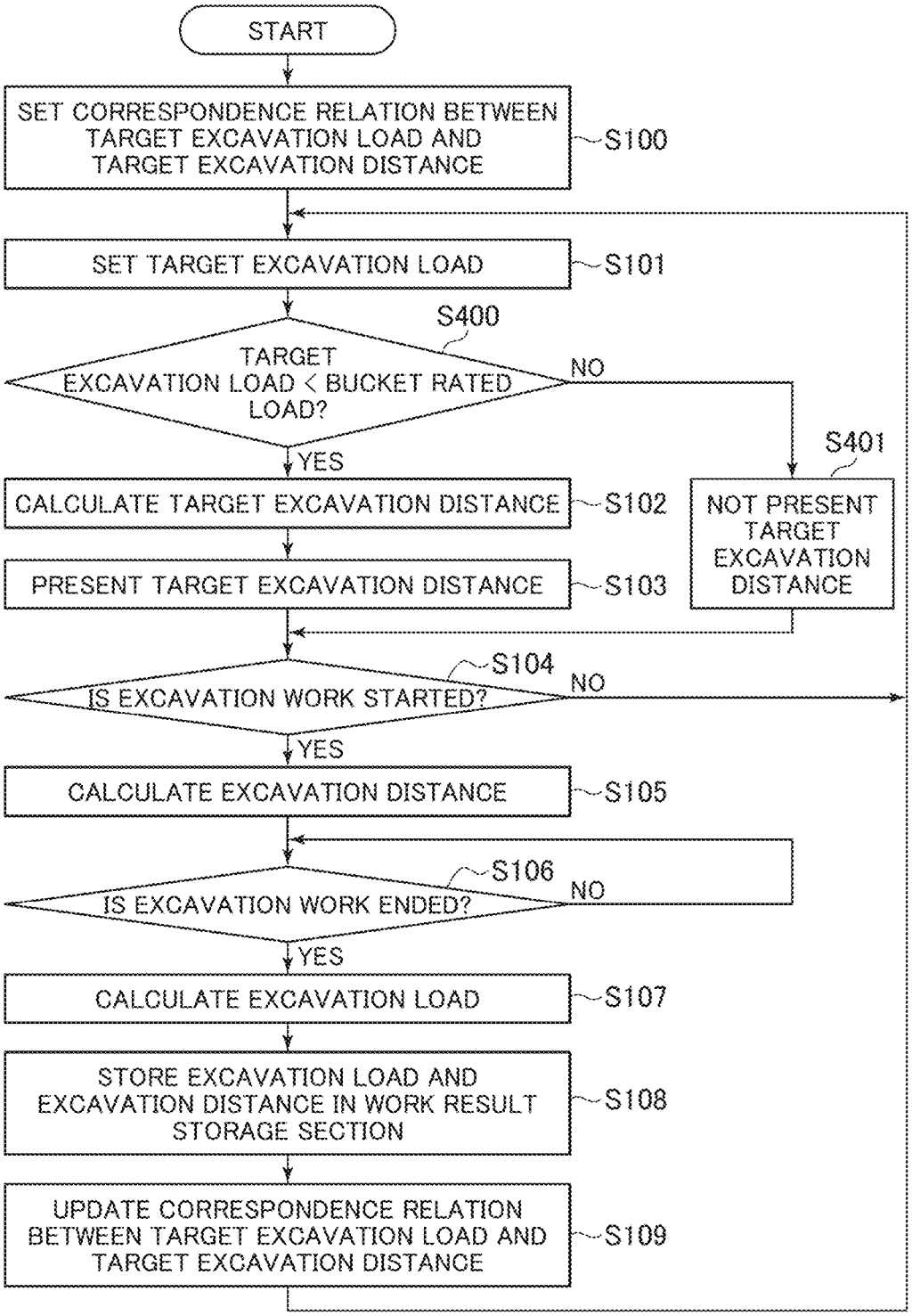
FIG. 20 is a flowchart of processing performed by a controller 21*d* according to the fourth embodiment.

FIG. 20 is a flowchart of processing performed by the controller 21*d* according to the fourth embodiment. In FIG. 20, steps S400 and S401 are added to the flowchart of the first embodiment (see FIG. 7).

In step S400, the controller 21*d* determines whether or not to display the target excavation load by using the target excavation distance notification determining section 64. The target excavation distance notification determining section 64 compares the target excavation load calculated in step S101 with the load value (rated load) of the excavation target object which load value (rated load) is calculated from the rated capacity of the bucket 15 which rated capacity is stored in the storage device of the controller 21*d* in advance. The target excavation distance notification determining section 64 proceeds to step S102 when the target excavation load is less than the rated load of the bucket 15. Otherwise, that is, when a load loadable onto the dump truck 2 is equal to or more than the rated load of the bucket 15, the target excavation distance notification determining section 64 proceeds to step S401.

In step S401, the display control section 58 sets the target excavation distance in the target excavation distance display section 84 on the monitor screen of FIG. 10 and the line 85 indicating the excavation start position within the assistance diagram display section 83 in a non-displayed state. At this time, the auxiliary lines 87 and the claw tip position 86 may also be set in a non-displayed state.

Advantages Obtained by Fourth Embodiment

In the present embodiment, the target excavation distance is not presented to the operator of the hydraulic excavator 1 when the dump truck cannot be overloaded. Thus, it is not necessary to aim at the target excavation distance by operation of the front work device 12. A psychological burden of the operator can therefore be reduced.

Fifth Embodiment

The present embodiment is characterized by allowing an excavation environment of the hydraulic excavator 1 to be set on the basis of an external input from an input device or the like, storing the excavation load and the excavation distance in association with each other for each set excavation environment, setting correspondence relation between the target excavation load and the target excavation distance for each excavation environment by using the stored information, and calculating the target excavation distance on the basis of the set correspondence relation, the excavation environment, and the target excavation load.

Figure 21:
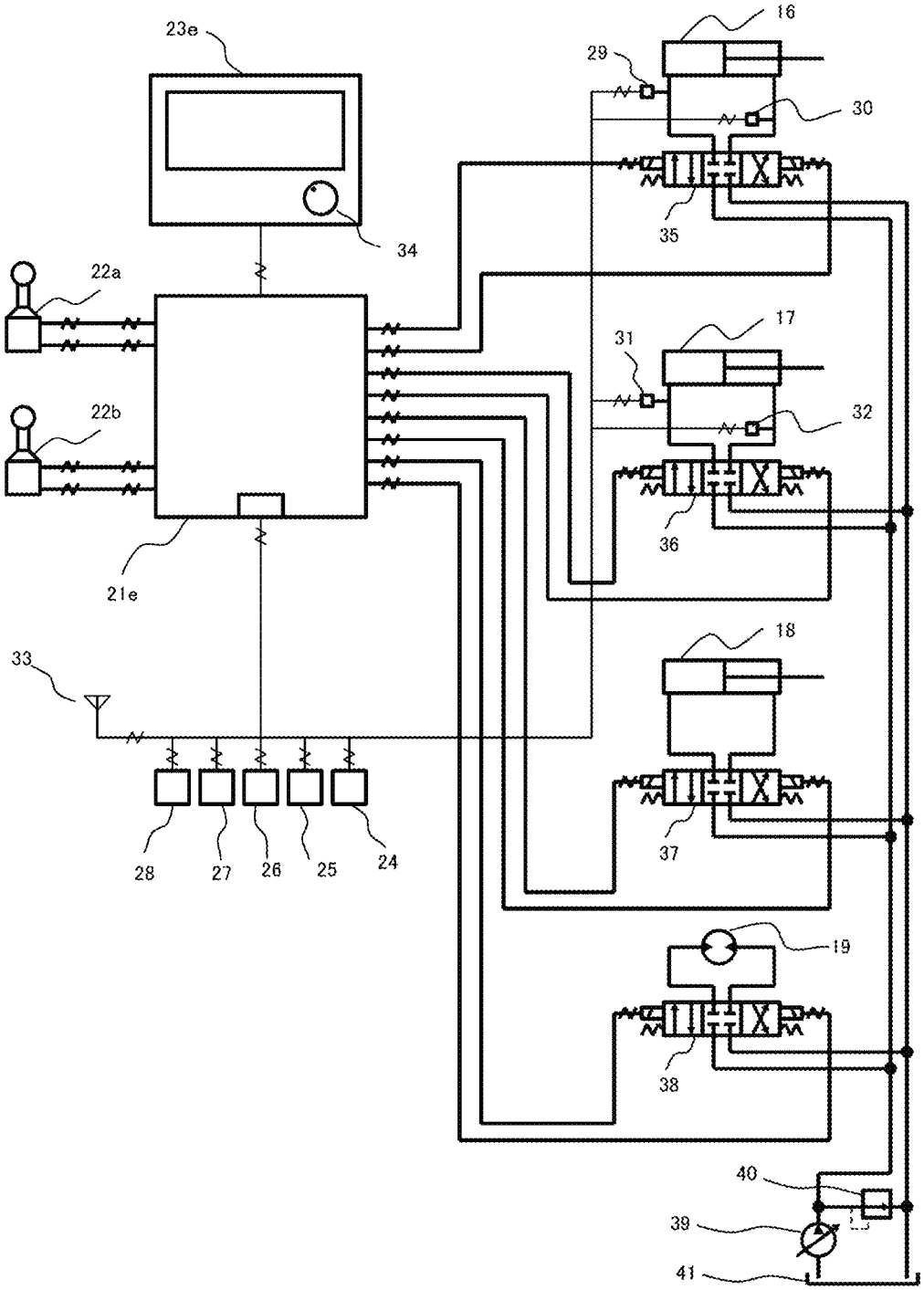
FIG. 21 is a schematic diagram of an excavation loading work guidance system of a hydraulic excavator 1 according to a fifth embodiment.

FIG. 21 is a schematic diagram of an excavation and loading work guidance system of a hydraulic excavator 1 according to a fifth embodiment. The present embodiment corresponds to a system configuration obtained by changing the monitor 23 to a monitor 23*e* having a switch 34 as an input device for setting the excavation environment of the hydraulic excavator 1 in the system configuration according to the first embodiment. The switch 34 in the present embodiment is a rotary switch, and is of a structure rotatable by a knob. A signal of the switch 34 is input to a controller 21*e*.

Figure 22:
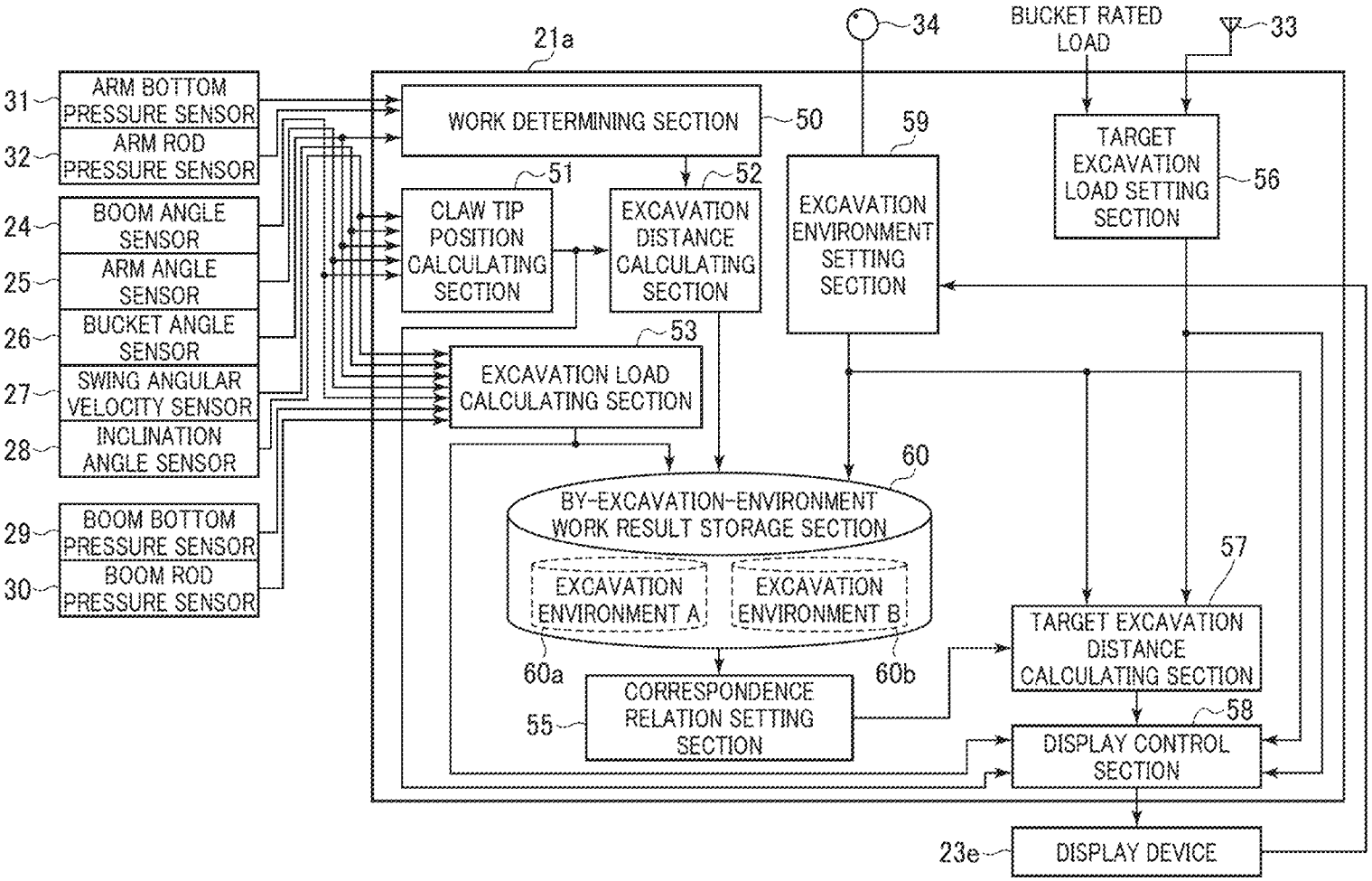
FIG. 22 is a schematic diagram illustrating a system configuration according to the fifth embodiment.

FIG. 22 is a schematic diagram illustrating a system configuration of the fifth embodiment. The controller 21*e* of FIG. 22 is configured by adding, to the controller 21 in the first embodiment illustrated in FIG. 6, an excavation environment setting section 59 that sets the excavation environment of the hydraulic excavator 1 on the basis of the signal output from the switch 34, and by changing the work result storage section 54 to a by-excavation-environment work result storage section 60 that stores the calculation result of the excavation load calculating section 53 and the calculation result of the excavation distance calculating section 52 in association with each other by excavation environment set by the excavation environment setting section 59. The correspondence relation setting section 55 sets correspondence relation between the target excavation load and the target excavation distance for each excavation environment set by the excavation environment setting section 59 by using information stored in the by-excavation-environment work result storage section 60. In addition, the target excavation distance calculating section 57 calculates the target excavation distance on the basis of the excavation environment set by the excavation environment setting section 59, the correspondence relation set by the correspondence relation setting section 55, and the target excavation load set by the target excavation load setting section 56. Output of the excavation environment setting section 59 is input also to the excavation distance calculating section 57 and the display control section 58.

Figure 23:
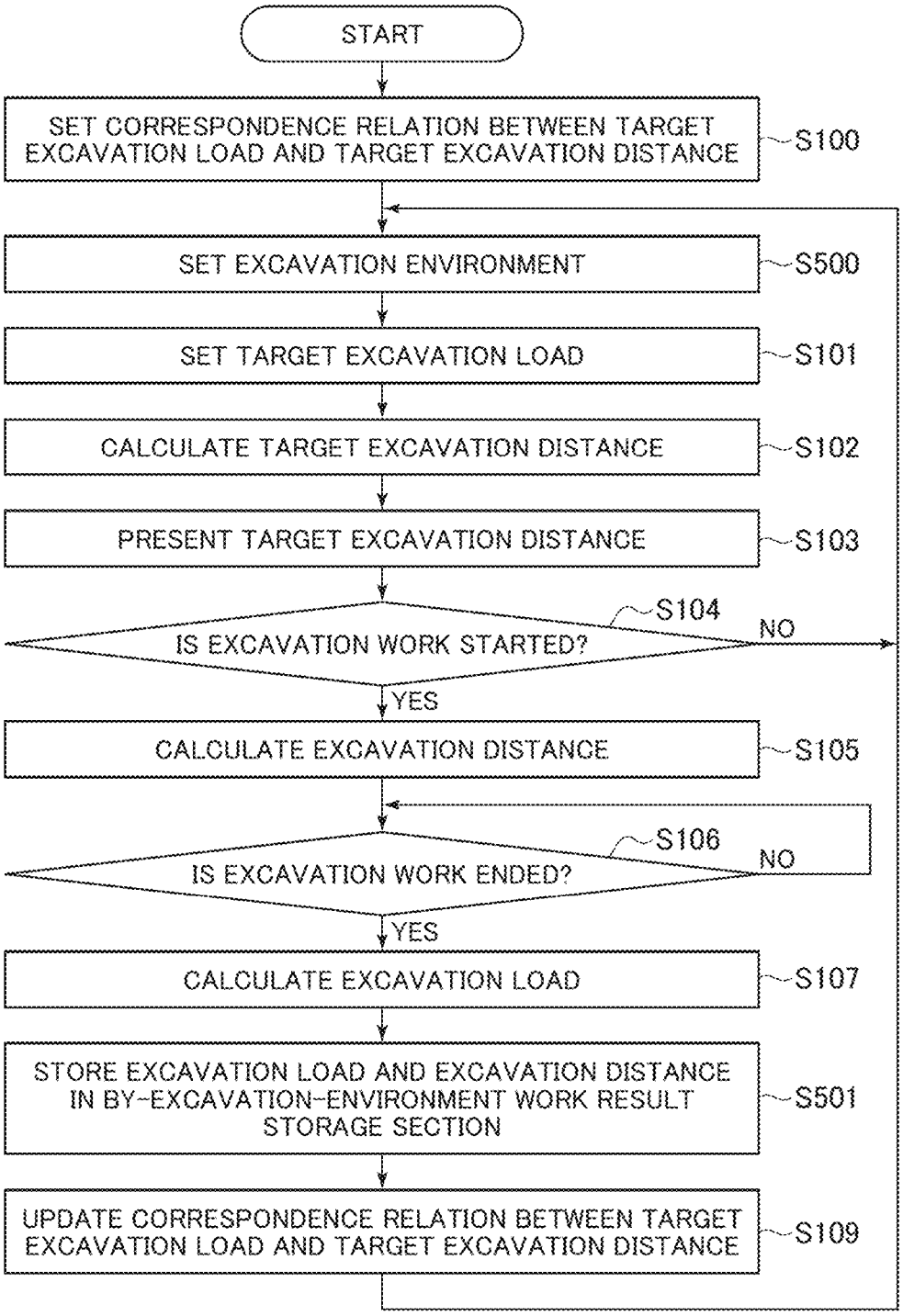
FIG. 23 is a flowchart of processing performed by a controller 21*e* according to the fifth embodiment.

FIG. 23 is a flowchart of processing performed by the controller 21*e* according to the fifth embodiment. In FIG. 23, step S500 is added to the flowchart of the first embodiment (see FIG. 7). In addition, step S108 of storing the excavation load and the excavation distance in the storage device is changed to step S501 of storing the excavation load and the excavation distance in the storage device by excavation environment.

Figure 24:
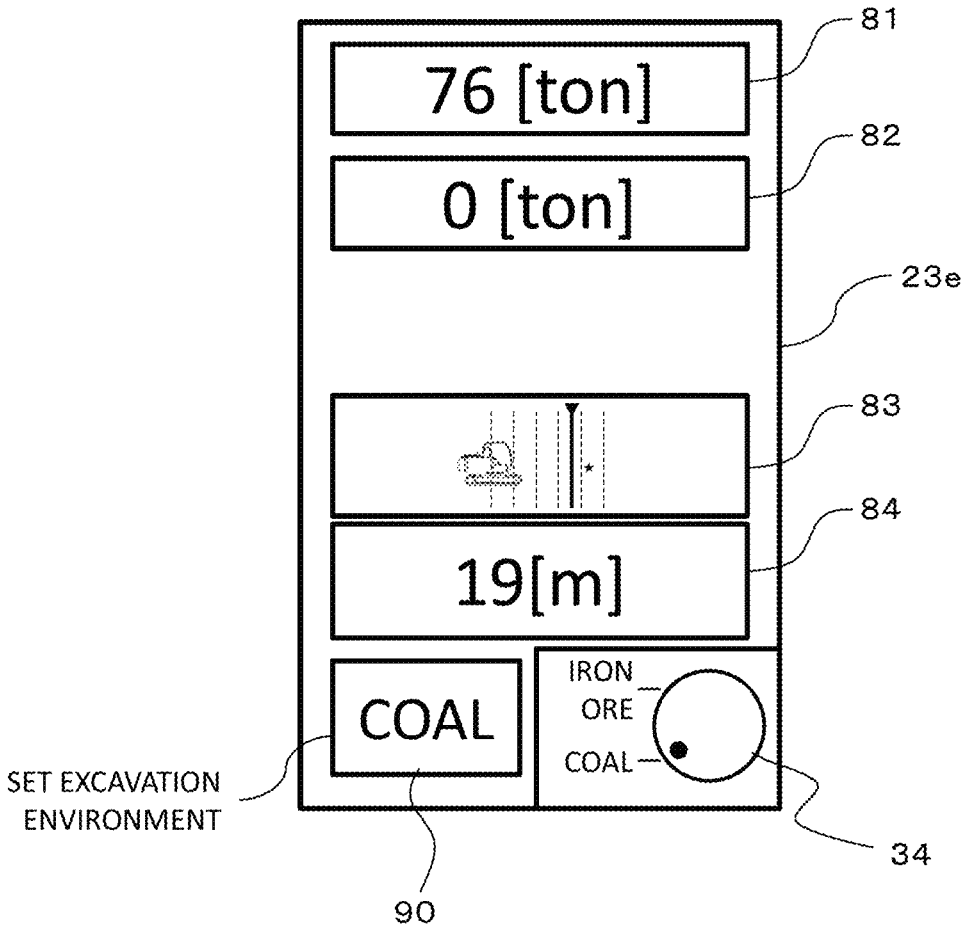
FIG. 24 is a diagram illustrating an example of the display screen of a monitor 23 according to the fifth embodiment.

In step S500, the controller 21*e* reads the signal from the switch 34 and sets an excavation environment by using the excavation environment setting section 59. The monitor 23*e* is configured as in FIG. 24. The operator can arbitrarily set an excavation environment by rotating the switch 34. In the present embodiment, the switch 34 is configured to enable selection of whether a kind of excavation target object is iron ore or coal as an excavation environment. The selected excavation target object is displayed in an excavation environment display section 90 on the monitor screen. The excavation target object differs in density and viscosity depending on the kind thereof, and there is thus a possibility of the rated load of the bucket changing. As a result, there is a possibility of the target excavation load also changing according to the excavation target object.

Other excavation environment classifications include, for example, a classification by the position of the excavation target object 3 with respect to the lower track structure 10 (upper digging in which the excavation target object 3 yet to be excavated is located above the bottom surface of the lower track structure 10 or lower digging in which the excavation target object 3 yet to be excavated is located below the bottom surface), a classification by operator, a classification by vehicle class of the hydraulic excavator, a classification by weather, a combination of these plurality of classifications, and the like. Incidentally, the input of the excavation environment is not limited to only the switch 34, but it is possible to use various kinds of input devices such as an input device having a plurality of buttons, a touch panel type monitor, and the like.

In step S501, the controller 21*e* stores the excavation load and the excavation distance in the by-excavation-environment work result storage section 60 by excavation environment set by the excavation environment setting section 59. In a case where iron ore is selected as the excavation target object by the switch 34 (case of an excavation environment A), data is stored in a work result storage section 60*a*. In a case where coal is selected (case of an excavation environment B), data is stored in a work result storage section 60*b*.

Advantages Obtained by Fifth Embodiment

The relation between the excavation load and the excavation distance greatly depends on the excavation environment. According to the present embodiment, however, the relation between the excavation load and the excavation distance is stored for each excavation environment, and the correspondence relation between the target excavation load and the target excavation distance can therefore be set for each excavation environment. When the target excavation distance adjusted to the excavation environment is then presented to the operator, the operator can operate the front work device 12 in a manner suitable for the excavation environment, and easily excavates and loads an appropriate amount adjusted to the excavation environment.

Sixth Embodiment

The present embodiment is characterized by calculating the second excavation distance as the excavation distance, that is, the excavation moving distance as a distance from the excavation start position to the excavation end position or the excavation trajectory length as the length of a trajectory along which the bucket claw tip moves from the excavation start position to the excavation end position, and setting the correspondence relation between the target excavation load and the target excavation distance (target value of the second excavation distance) from data on the excavation distance (second excavation distance) and the excavation load.

Figure 25:
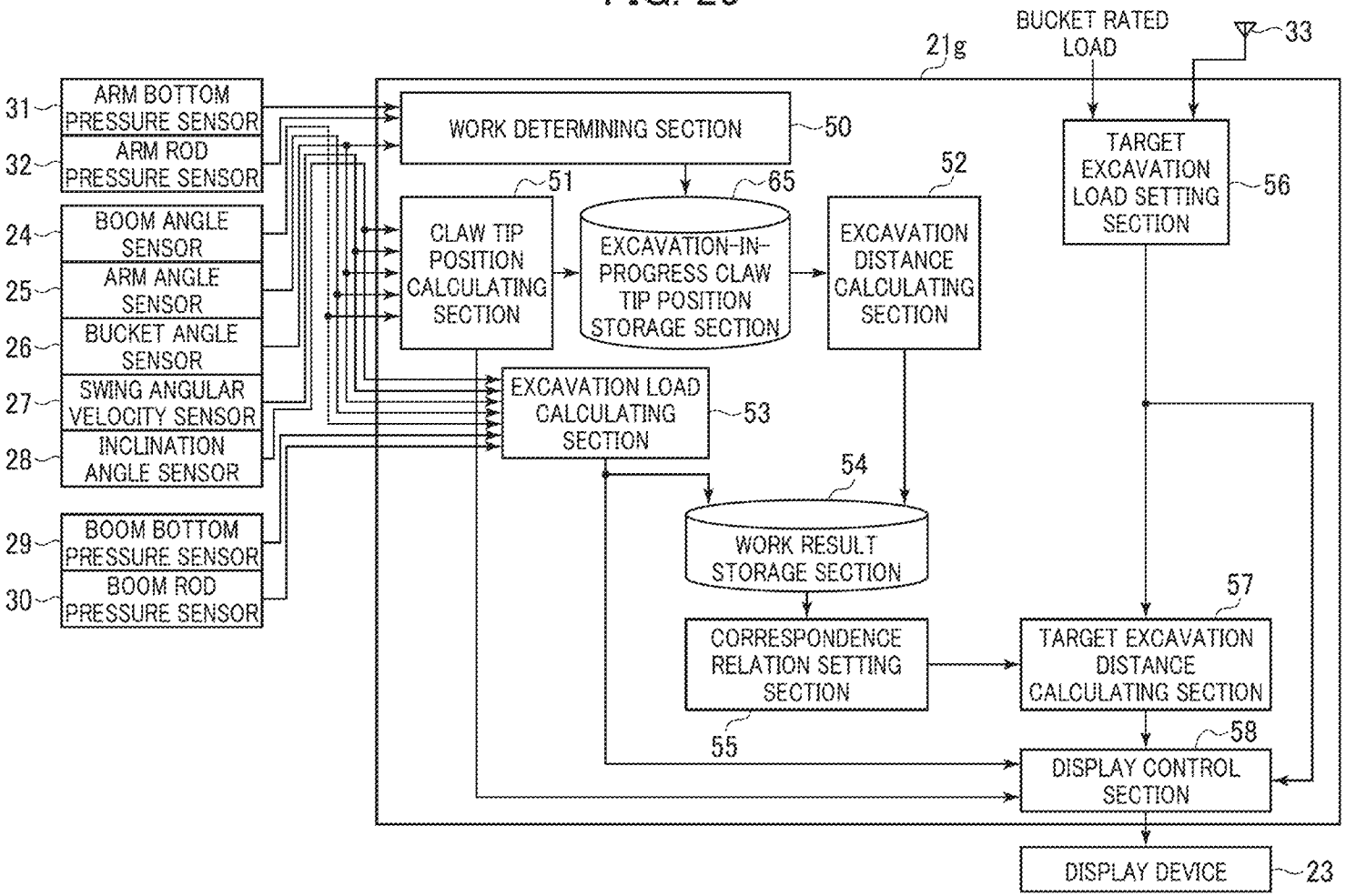
FIG. 25 is a schematic diagram illustrating a system configuration according to a sixth embodiment.

FIG. 25 is a schematic diagram illustrating a system configuration according to a sixth embodiment. A controller 21*g* of FIG. 25 is configured by adding an excavation-in-progress claw tip position storage section 65 to the controller 21 in the first embodiment illustrated in FIG. 6. The excavation-in-progress claw tip position storage section 65 stores a history of the bucket claw tip position (that is, the trajectory of the bucket claw tip) moved from the excavation start position to the excavation end position on the basis of the determination result of the work determining section 50 and the calculation result of the claw tip position calculating section 51. The excavation distance calculating section 52 calculates the length of the trajectory of the bucket claw tip as the excavation distance from the position history stored in the excavation-in-progress claw tip position storage section 65, and outputs the length of the trajectory of the bucket claw tip to the work result storage section 54.

Figure 26:
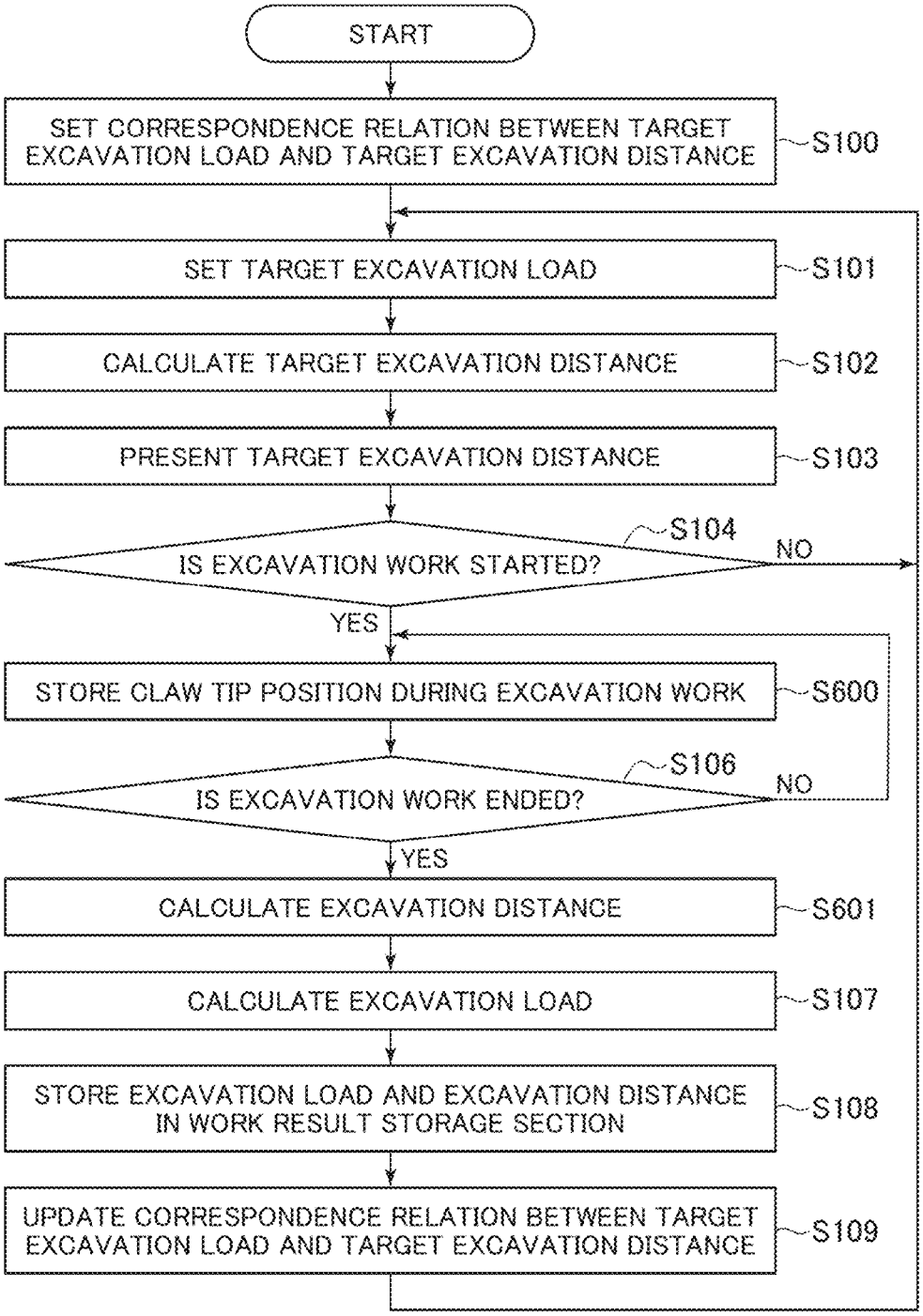
FIG. 26 is a flowchart of processing performed by a controller 21*g* according to the sixth embodiment.

FIG. 26 is a flowchart of processing performed by the controller 21*g* according to the sixth embodiment. In FIG. 26, step S600 is added to the flowchart of the first embodiment (see FIG. 7), and steps S103 to S106 are changed.

In step S104, the work determining section 50 determines whether or not excavation work is started. When the work determining section 50 determines that excavation work is started, the work determining section 50 proceeds to step S600.

In step S600, the controller 21*g* stores the calculation result of the claw tip position calculating section 51 in the excavation-in-progress claw tip position storage section 65. The controller 21*g* then proceeds to step S106. In step S106, the work determining section 50 determines whether or not the excavation work is ended. When it is determined that the excavation work is in progress, the processing returns to step S600 to continue storing the claw tip position in the excavation-in-progress claw tip position storage section 65. When it is determined that the excavation work is ended, on the other hand, the processing proceeds to step S601. The processing of steps S104, S600, and S106 stores a history of the bucket claw tip position from the time of the start of the excavation work to the time of the end of the excavation work in the excavation-in-progress claw tip position storage section 65.

Figure 27:
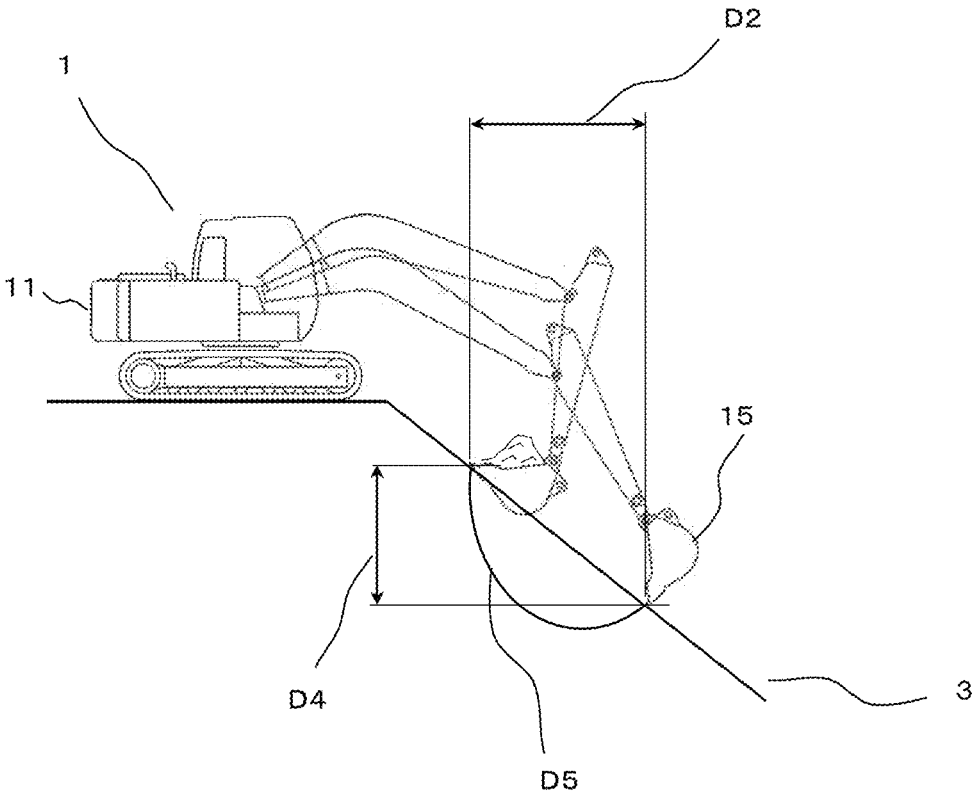
FIG. 27 is a diagram of assistance in explaining a second excavation distance.

In step S601, the excavation distance is obtained from the excavation-in-progress claw tip position history stored in the excavation-in-progress claw tip position storage section 65. As illustrated in FIG. 27, cited as the excavation distance obtained from the history of the excavation-in-progress claw tip position is a horizontal excavation moving distance D2 from the excavation start position to the excavation end position, a vertical excavation moving distance D4 from the excavation start position to the excavation end position, a length (excavation trajectory length) D5 of the trajectory of the claw tip of the bucket 15 during the excavation work, or the like. In the present embodiment, the horizontal excavation moving distance D2 is set as the excavation distance. The horizontal excavation moving distance D2 can be calculated easily on the basis of the claw tip position at the time of the start of the excavation and the claw tip position at the time of the end of the excavation, the claw tip positions being stored in the excavation-in-progress claw tip position storage section 65.

Figure 28:
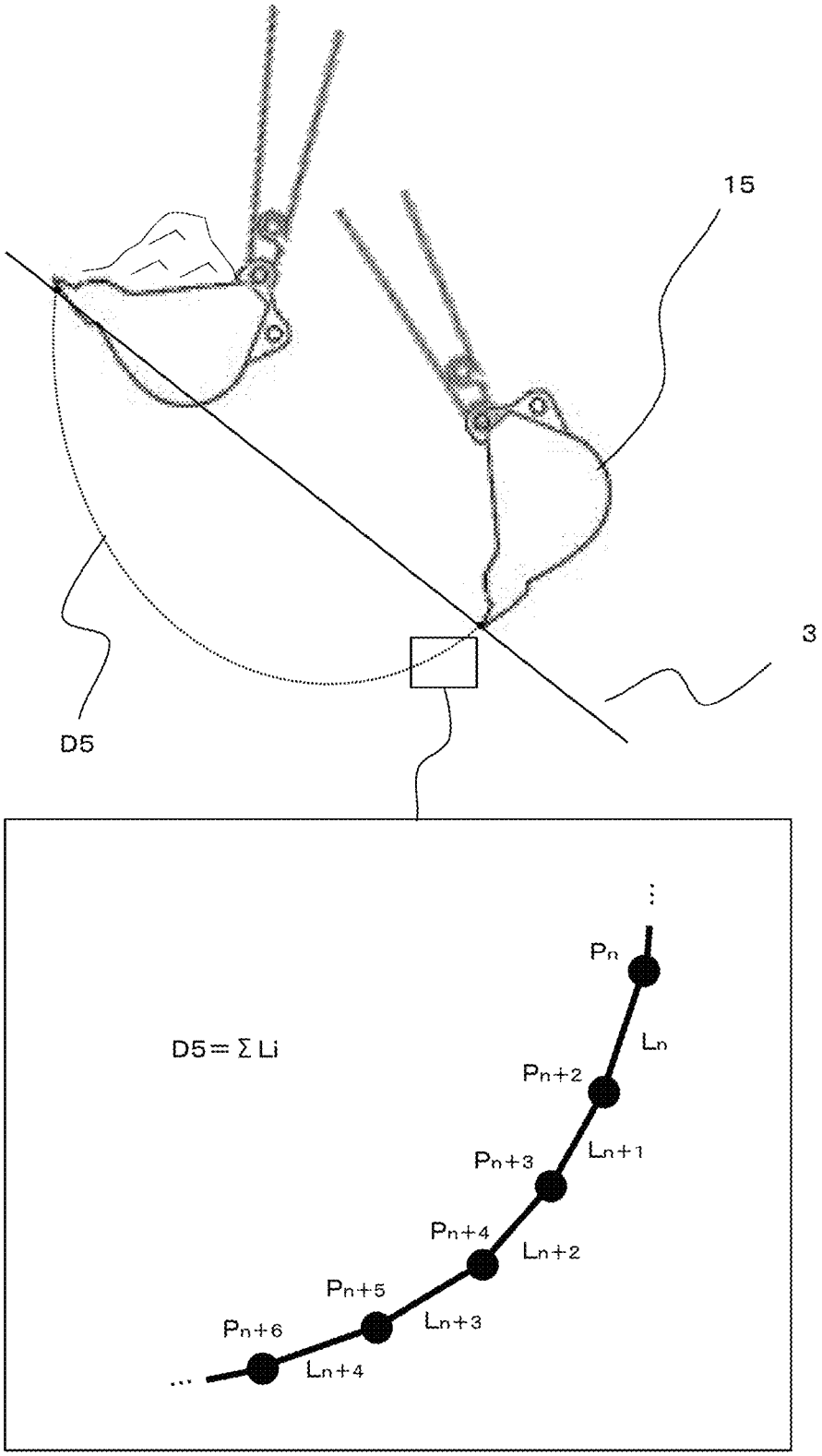
FIG. 28 is a diagram of assistance in explaining a length (excavation trajectory length) D5 of a trajectory of a claw tip of the bucket 15 in excavation work.

Incidentally, the length D5 of the trajectory of the claw tip can be calculated by integrating the length of a straight line $L_n$ including claw tip positions $P_n$ and $P_{n+1}$ during the excavation work which claw tip positions are stored in the excavation-in-progress claw tip position storage section 65, as illustrated in FIG. 28.

The monitor 23 according to the present embodiment displays a screen similar to that of FIG. 10 in the first embodiment. However, suppose that the straight line 85 indicating the excavation start position in the assistance diagram is calculated from the history stored in the excavation-in-progress claw tip position storage section 65, and is displayed after the start of the excavation work. When a display period is further limited, it is preferable to display the straight line 85 during a period from the start of the excavation work to the end of the excavation work, that is, while step 600 in FIG. 26 is performed. The thus displayed straight line 85 indicates an actual excavation start position, and therefore serves as a reference when the operator recognizes the excavation moving distance. Incidentally, when the length D5 of the trajectory of the claw tip of the bucket 15 of the hydraulic excavator 1 during the excavation work is used as the excavation distance, the display of the straight line 85 in the assistance diagram may be omitted.

Advantages Obtained by Sixth Embodiment

The operator of the hydraulic excavator 1 does not cause overloading or insufficient loading as a result of not knowing the method of operating the front work device 12 of the hydraulic excavator 1 from the time point of the start of the excavation work in operating the front work device 12 of the hydraulic excavator 1 by referring to the information displayed on the monitor 23 even when the operator lacks in skill and experience. The operator therefore loads an appropriate amount easily.

Seventh Embodiment

The present embodiment is characterized by displaying the target value of the first excavation distance (target first excavation distance) on the monitor 23 before a start of excavation work, and displaying the target value of the second excavation distance (target second excavation distance) on the monitor 23 after the start of the excavation work. The "first excavation distance" is distance information indicating the position of the claw tip of the bucket 15 at a time of the start of the excavation work, and is defined as a distance from the reference point set to the main body (the upper swing structure 11 or the lower track structure 10) of the hydraulic excavator 1 to the bucket claw tip position at the time of the start of the excavation in the present document. D1 and D3 (see FIG. 3), for example, correspond to the first excavation distance. The "second excavation distance" is distance information indicating the position of the claw tip of the bucket 15 at a time of an end of the excavation work, and is defined as a distance from the bucket claw tip position at the time of the start of the excavation to the bucket claw tip position at the time of the end of the excavation in the present document. D2, D4, and D5 (see FIG. 27), for example, correspond to the second excavation distance. In the present embodiment, the horizontal excavation start distance D1 is used as the first excavation distance, and the horizontal excavation moving distance D2 is used as the second excavation distance.

A system configuration according to the present embodiment is the same as in the sixth embodiment. The controller 21*g* in the present embodiment is configured by adding the excavation-in-progress claw tip position storage section 65 to the controller 21 in the first embodiment illustrated in FIG. 6. The excavation distance calculating section 52 calculates the claw tip position of the bucket 15 when the work determining section 50 determines that the excavation work is started as the first excavation distance, and calculates the second excavation distance on the basis of a history of the claw tip position of the bucket 15 during a period during which the work determining section 50 determines that the excavation work is being performed (this information is obtained from the excavation-in-progress claw tip position storage section 65). The work result storage section 54 stores the excavation load calculated by the excavation load calculating section 53 and the first excavation distance and the second excavation distance calculated by the excavation distance calculating section 52 in association with each other. The correspondence relation setting section 55 sets correspondence relation between the target excavation load as the target value of the excavation load and the target first excavation distance and the target second excavation distance as the target values of the first excavation distance and the second excavation distance on the basis of a tendency of the correspondence relation between the excavation load and the first excavation distance and the second excavation distance stored in the work result storage section 54. The target excavation distance calculating section 57 calculates the target first excavation distance and the target second excavation distance on the basis of the correspondence relation set by the correspondence relation setting section 55 and the target excavation load set by the target excavation load setting section 56. The monitor 23 displays the target first excavation distance and the target second excavation distance calculated by the target excavation distance calculating section 57.

Figure 29:
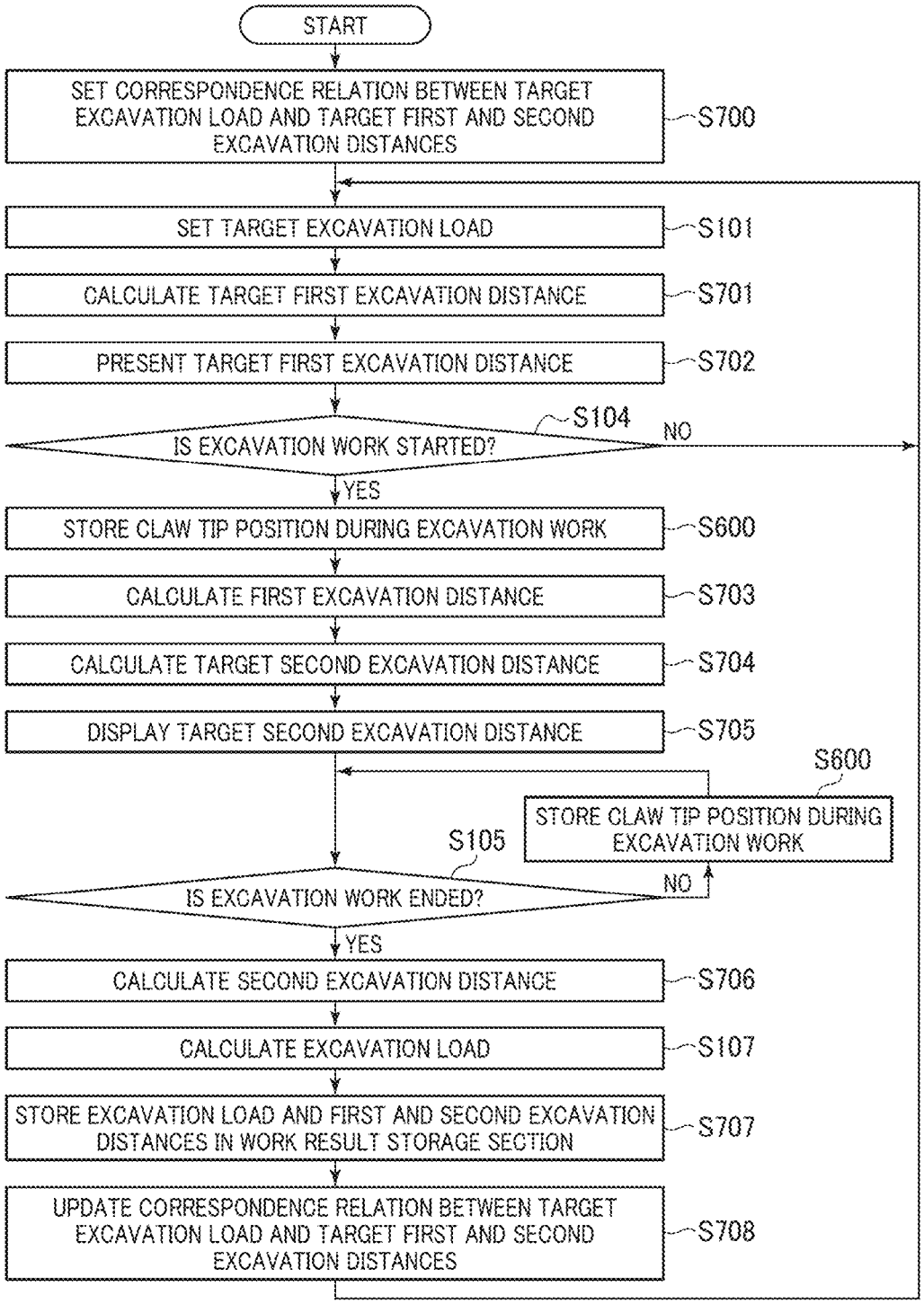
FIG. 29 is a flowchart of processing performed by a controller 21*g* according to a seventh embodiment.

FIG. 29 is a flowchart of processing performed by the controller 21*g* according to a seventh embodiment. In FIG. 29, steps S700 to S708 are added to the flowchart of the sixth embodiment (see FIG. 26).

Figure 31:
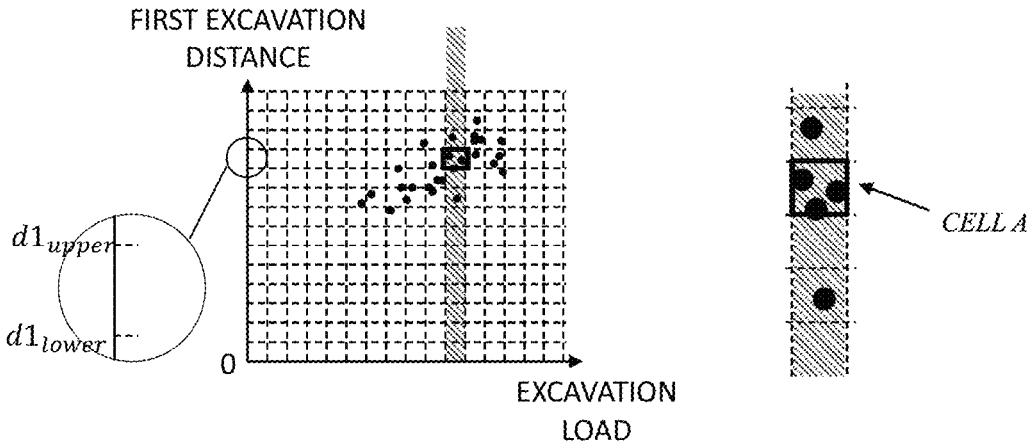
FIG. 31 is a diagram of assistance in explaining an example of setting correspondence relation between a target excavation load and a target first excavation distance by storing the data of the excavation load and the first excavation distance extracted from the information stored in the work result storage section 54 into each cell of a grid.
Figure 32:
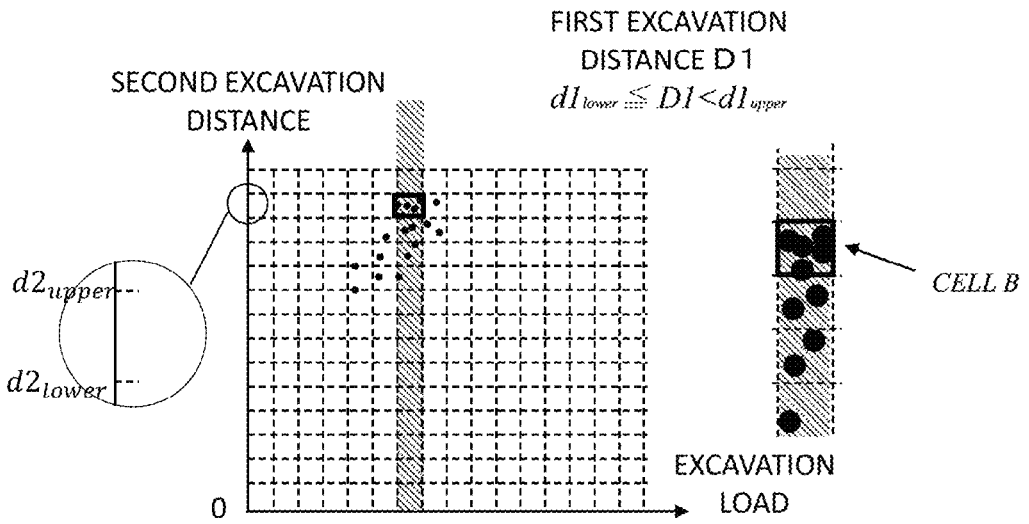
FIG. 32 is a diagram of assistance in explaining an example of extracting the excavation load and the second excavation distance where the first excavation distance D1 is $d1_{lower} \leq D1 < d1_{upper}$, the excavation load and the second excavation distance forming a pair, from the information stored in the work result storage section 54, and setting correspondence relation between the target excavation load and a target second excavation distance by storing the extracted data into each cell of a grid.

In step S700, the controller 21*g* reads the information of the excavation load and the first excavation distance and the second excavation distance stored in the work result storage section 54 as in FIG. 30, and sets the correspondence relation between the excavation load and the first excavation distance and the second excavation distance as illustrated in FIG. 31 and FIG. 32 by using the correspondence relation setting section 55.

FIG. 30 illustrates a form in which the excavation load and the first excavation distance D1 and the second excavation distance D2 are stored as one set of data in the work result storage section 54. Each piece of excavation work is identified by an excavation ID, and the excavation load and the first excavation distance and the second excavation distance calculated in each piece of excavation work are stored as one set of data in the work result storage section 54.

FIG. 31 and FIG. 32 illustrate an example of the correspondence relation set by the correspondence relation setting section 55. FIG. 31 illustrates relation between the excavation load and the first excavation distance. FIG. 31 is a diagram of assistance in explaining an example of setting the correspondence relation between the target excavation load and the target first excavation distance by storing the data of the excavation load and the first excavation distance extracted from the information stored in the work result storage section 54 into each cell of a grid formed by dividing each of the excavation load and the first excavation distance at equal intervals. The correspondence relation setting section 55 counts the number of data sets of the excavation load and the first excavation distance stored in each cell of the grid, and determines a cell A including most data in each excavation load interval. Then, a representative value $D1_{rep}$ of the first excavation distance of the cell A including the most data in each excavation load interval is calculated, and the correspondence relation between the target excavation load and the target first excavation distance is set by the excavation load interval and the representative value $D1_{rep}$ of the first excavation distance. The representative value $D1_{rep}$ of the first excavation distance may be an intermediate value $D1_{rep}=(d1_{upper}+d1_{lower})/2$ in the interval, an average value $D1_{rep}=\text{mean}\ (d1|d1\in A)$ of the first excavation distance of the data within the grid, or a median value $D1_{rep}=\text{median}\ (d1|d1\in A)$ of the first excavation distance of the data within the grid. The target excavation distance calculating section 57 outputs a first excavation distance representative value $D1_{rep\ i}$ as the target first excavation distance when an input target excavation load W corresponds to an excavation load interval $w_i \leq W < w_{i+1}$, for example, on the basis of the correspondence relation between the target excavation load and the target first excavation distance which correspondence relation is established by the correspondence relation setting section 55.

Incidentally, as in the first embodiment, when the number of pieces of information stored in the work result storage section 54 in the excavation load interval $w_i \leq W < w_{i+1}$ does not satisfy a threshold value set in advance, the correspondence relation setting section 55 may output an error code to the target excavation distance calculating section 57 in place of the first excavation distance representative value $D1_{rep\ i}$.

FIG. 32 is a diagram of assistance in explaining an example of extracting the excavation load and the second excavation distance where the first excavation distance D1 is $d1_{lower} \leq D1 < d1_{upper}$ the excavation load and the second excavation distance forming a pair, from the information stored in the work result storage section 54, and setting the correspondence relation between the target excavation load and the target second excavation distance by storing the extracted data into each cell of a grid formed by dividing each of the excavation load and the second excavation distance at equal intervals. The correspondence relation setting section 55 counts the number of data sets of the excavation load and the second excavation distance stored in each cell of the grid, and determines a cell B including most data in each excavation load interval. Then, a representative value $D2_{rep}$ of the second excavation distance of the cell B including the most data in each excavation load interval is calculated, and the correspondence relation between the target excavation load and the target second excavation distance in the case where the first excavation distance D1 is $d1_{lower} \leq D1 < d1_{upper}$ is set using the representative value $D2_{rep}$ of the second excavation distance. The representative value $D2_{rep}$ of the second excavation distance in the case where the first excavation distance D1 is $d1_{lower} \leq D1 < d1_{upper}$ may be an intermediate value $D2_{rep} = (d1_{upper} + d2_{lower})/2$ in the interval, an average value $D2_{rep} = \text{mean}(d2 | d2 \in B)$ of the second excavation distance of the data within the grid, or may be a median value $D2_{rep} = \text{median}(d2 | d2 \in B)$ of the first excavation distance of the data within the grid. The correspondence relation setting section 55 similarly sets the correspondence relation between the target excavation load and the target second excavation distance over an entire range of the first excavation distance D1.

Incidentally, as in the case of the first excavation distance, when the number of pieces of information stored in the work result storage section 54 in the excavation load interval $w_i \leq W < w_{i+1}$ in the case where the first excavation distance D1 is $d1_{lower} \leq D1 < d1_{upper}$ does not satisfy a threshold value set in advance, the correspondence relation setting section 55 may output an error code to the target excavation distance calculating section 57 in place of the second excavation distance representative value $D2_{rep\ i}$.

In step S701, the target first excavation distance is calculated by using the target excavation distance calculating section 57 using the set target excavation load and the relation between the excavation load and the first excavation distance which relation is set by the correspondence relation setting section 55. In addition, when the error code is input as the set relation, the target excavation distance calculating section 57 outputs the error code to the display control section 58 to be described later in place of the target excavation distance.

Figure 33:
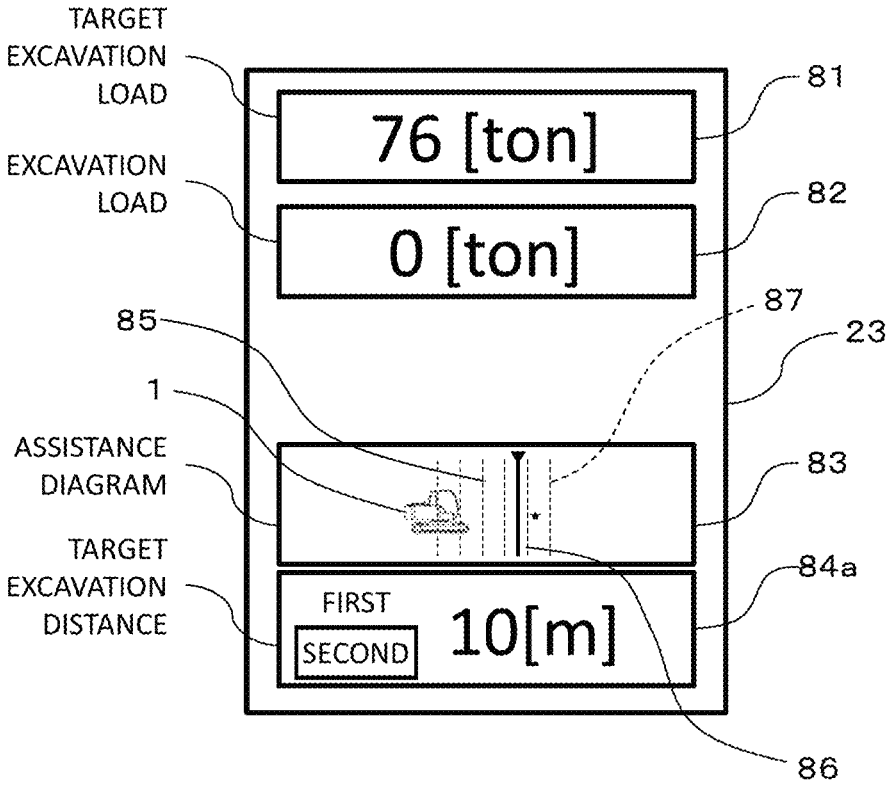
FIG. 33 is a diagram illustrating an example of the display screen of a monitor 23 according to the seventh embodiment.

In step S702, the display control section 58 presents the target first excavation distance calculated in step S701 to the operator via the monitor 23. FIG. 33 is a diagram illustrating an example of information displayed on the monitor screen in the present embodiment. The display screen of FIG. 33 includes a target excavation distance display section 84*a* that displays the numerical values of the target first excavation distance and the target second excavation distance calculated in step S701 and step S704 to be described later. There are two indications written as "first" and "second" on the left side of the target excavation distance display section 84*a*. A rectangle enclosing one of the two indications indicates whether the target excavation distance displayed in the target excavation distance display section 84*a* is the target first excavation distance or the target second excavation distance. When the target first excavation distance is displayed, the assistance diagram is displayed as in the first embodiment within the assistance diagram display section 83 together with the numerical value of the target first excavation distance. That is, the simple diagram of the hydraulic excavator 1, the auxiliary lines 87, the straight line 85 indicating the excavation start position, and the dot 86 indicating the bucket claw tip position calculated by the claw tip position calculating section 51 are displayed. The assistance diagram enables even an operator lacking in skill and experience to easily grasp the target first excavation distance from the operation seat and the present bucket claw tip position.

In addition, when the error code is output as a result of the calculation of the target first excavation distance in step S701, an error message may be displayed in the target excavation distance display section 84*a* as in the first embodiment, and the straight line 85 may not be displayed in the assistance diagram.

In step S703, the controller 21 calculates the first excavation distance D1. The first excavation distance D1 can be calculated from position history data stored in the excavation-in-progress claw tip position storage section 65 in step S600 immediately after the start of the excavation work.

In step S704, the target excavation distance calculating section 57 calculates the target second excavation distance using the target load set in step S101, the first excavation distance calculated in step S703, and the correspondence relation between the target excavation load and the target first excavation distance which correspondence relation is set by the correspondence relation setting section 55 in step S700 or S708. For example, when the target excavation load $W_{goal}$ is $w_i \leq W_{goal} < w_{i+1}$, and the first excavation distance $D1_{cur}$ calculated in step S703 is $d1_{lower} \leq D1_{cur} < d1_{upper}$ a second excavation distance representative value $D2_{rep\ i}$ in the excavation load interval $w_i \leq W < w_{i+1}$ in the case where $d1_{lower} \leq D1 < d1_{upper}$ is output as the target second excavation distance. In addition, when the error code is input as the set relation, the target excavation distance calculating section 57 outputs the error code to the display control section 58 in place of the target second excavation distance.

In step S705, the display control section 58 presents the target second excavation distance calculated in step S704 to the operator via the monitor 23. At this time, the target first excavation distance and the assistance diagram displayed in step S702 are updated. That is, of the "first" and the "second" displayed on the left side of the target excavation distance display section 84*a*, the "second" is selected by the rectangle, and indicates that the target excavation distance displayed in the target excavation distance display section 84*a* is the target second excavation distance. At this time, the straight line 85 displayed in the assistance diagram display section 83 is changed to one that indicates the excavation end position. This assistance diagram enables even an operator lacking in skill and experience to easily grasp the target second excavation distance from the operation seat and the present bucket claw tip position. However, suppose that when the length D5 of the trajectory of the bucket claw tip of the hydraulic excavator 1 is used as the second excavation distance, the display of the straight line 85 indicating the excavation end position is omitted.

In addition, when the error code is output as a result of the calculation of the target second excavation distance in step S704, an error message may be displayed in the target excavation distance display section 84*a* as in the first embodiment, and the straight line 85 may not be displayed in the assistance diagram.

When it is determined in step S105 that the excavation work is ended, the controller 21 calculates the second excavation distance D2 in step S706, using the excavation-in-progress claw tip position history stored in the excavation-in-progress claw tip position storage section 65. The second excavation distance D2 can be calculated by a method similar to the calculation of the excavation distance in step S601 of the sixth embodiment.

In step S707, the controller 21 additionally stores the first excavation distance, the second excavation distance, and the excavation load calculated in step S703, step S706, and step S107 in the work result storage section 54. That is, the excavation load, the first excavation distance, and the second excavation distance in the excavation work actually performed are stored as a set in the work result storage section 54, as illustrated in FIG. 30.

In step S708, the controller 21*g* updates the correspondence relation between the target excavation load and the target first excavation distance and the target second excavation distance by using the correspondence relation setting section 55. The correspondence relation setting section 55 sets the correspondence relation between the target excavation load and the target first excavation distance and the target second excavation distance as in step S700, using the information of the work result storage section 54 which information includes the information of the excavation load and the first and second excavation distances newly added in step S707.

Incidentally, in addition to the above-described combination of D1 and D2, combinations of the first excavation distance and the second excavation distance also include, for example, a combination of the vertical excavation start distance D3 and the vertical excavation moving distance D4, a combination of the horizontal excavation start distance D1 and the excavation trajectory length D5, and a combination of the vertical excavation start distance D3 and the excavation trajectory length D5.

Advantages Obtained by Seventh Embodiment

According to the present embodiment, not only is the target value of the first excavation distance displayed on the monitor 23 before the start of the excavation work as in the first embodiment, but also the target value of the second excavation distance is promptly displayed on the monitor 23 after the start of the excavation work. That is, not only the excavation start position but also the excavation end position can be presented to the operator as information assisting in front implement operation for obtaining the target excavation load. It therefore becomes even easier to bring an actual excavation load close to the target excavation load.

Eighth Embodiment

The present embodiment is characterized by calculating the ratio of a present second excavation distance to the target second excavation distance as a progress degree after a start of excavation work (that is, usually during arm crowding operation), and displaying the progress degree on the monitor 23.

Figure 34:
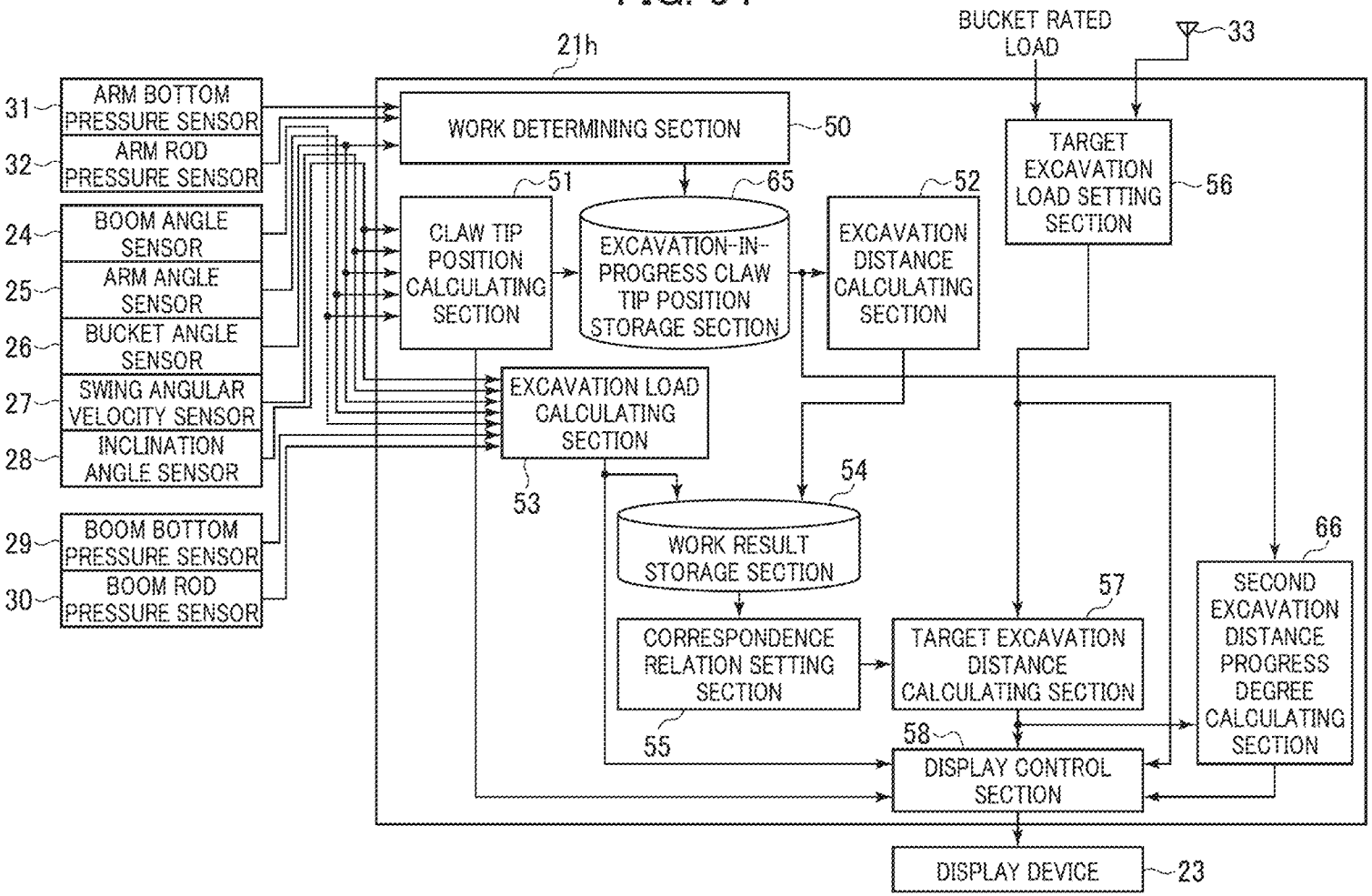
FIG. 34 is a schematic diagram illustrating a system configuration according to an eighth embodiment.

FIG. 34 is a schematic diagram illustrating a system configuration according to an eighth embodiment. A controller 21*f* of FIG. 34 is configured by adding a second excavation distance progress degree calculating section 66 to the controller 21*g* in the seventh embodiment illustrated in FIG. 25. The second excavation distance progress degree calculating section 66 calculates a second excavation distance progress degree as the ratio of the second excavation distance calculated by the excavation distance calculating section 52 to the target second excavation distance calculated by the target excavation distance calculating section 57. The second excavation distance progress degree is output to the display control section 58. The second excavation distance progress degree is displayed on the monitor screen.

Figure 35:
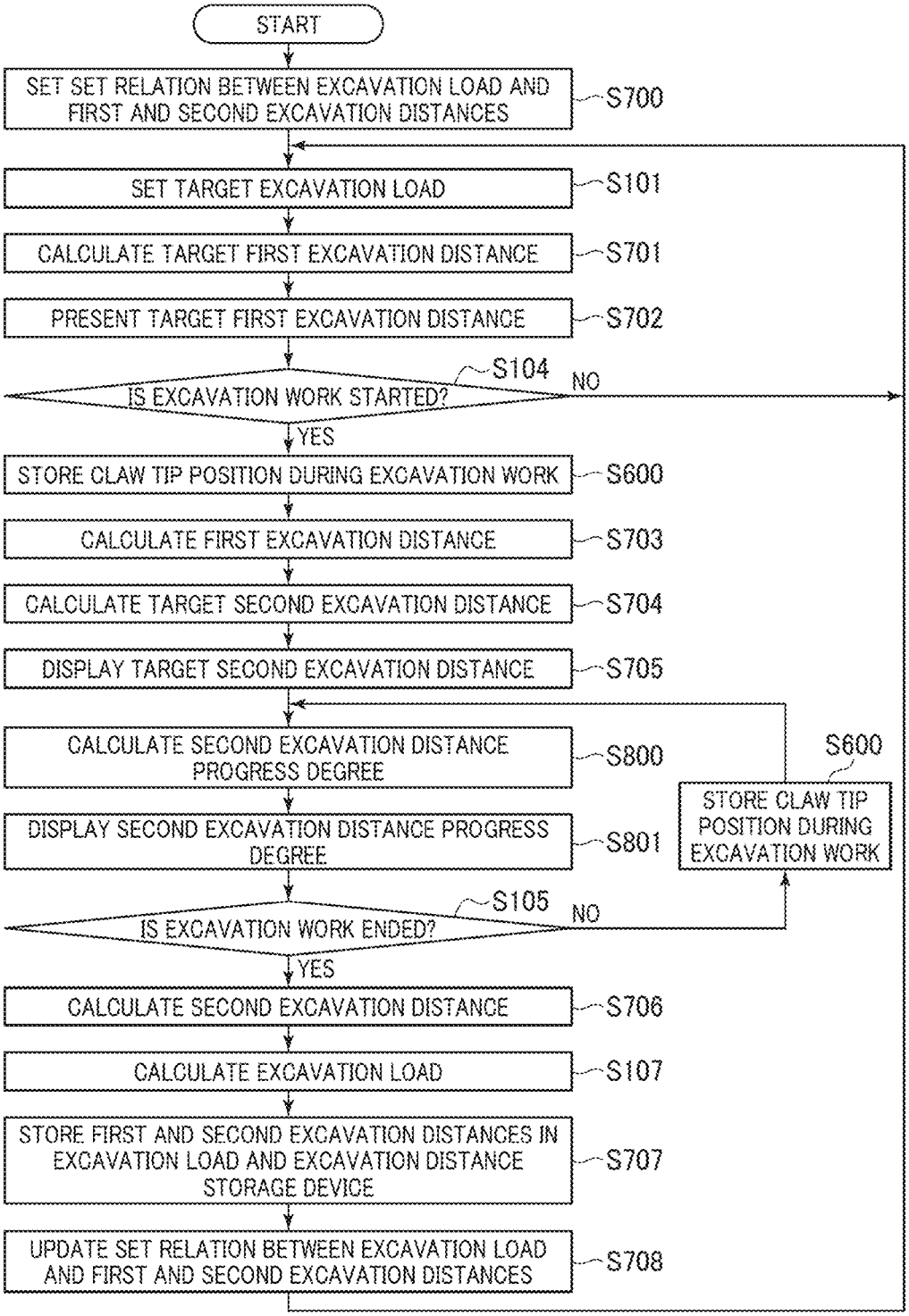
FIG. 35 is a flowchart of processing performed by a controller 21*f* according to the eighth embodiment.

FIG. 35 is a flowchart of processing performed by the controller 21*f* according to the eighth embodiment. In FIG. 35, step S800 and step S801 are added to the flowchart (see FIG. 29) of the seventh embodiment.

In step S800, the second excavation distance progress degree calculating section 66 calculates the second excavation distance progress degree. The second excavation distance progress degree as the ratio of the second excavation distance to the target second excavation distance is calculated on the basis of the target second excavation distance calculated from the target excavation distance calculating section 57 and the history of the bucket claw tip position which history is stored in the excavation-in-progress claw tip position storage section 65. In the present embodiment, the second excavation distance progress degree is expressed as a percentage. Suppose that also in the present embodiment, as in the seventh embodiment, the distance D1 in the horizontal direction from the swing center of the upper swing structure 11 to the excavation start position is used as the first excavation distance, and the horizontal distance D2 from the excavation start position to the excavation end position is used as the second excavation distance. For example, when a horizontal distance from the excavation start position to the present bucket claw tip position is 4 meters with respect to a target second excavation distance of 10 meters from the history of the bucket claw tip position which history is stored in the excavation-in-progress claw tip position storage section 65, the second excavation distance progress degree is 4 m/10 m×100=40%.

Figure 36:
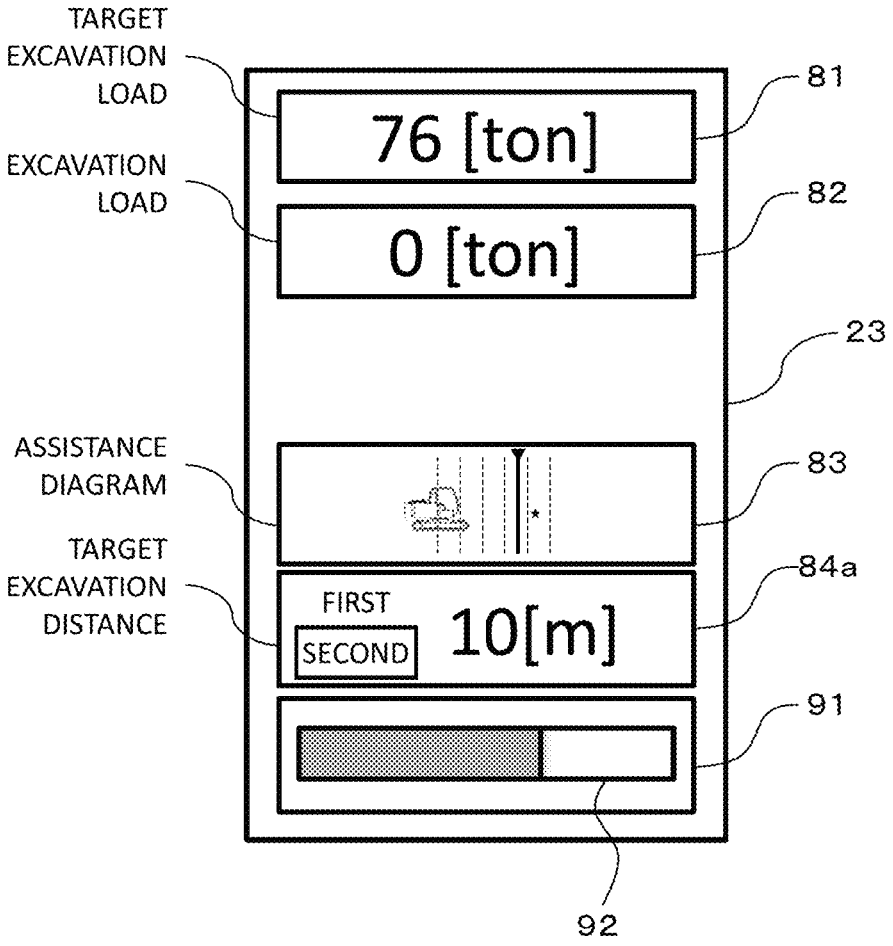
FIG. 36 is a diagram illustrating an example of the display screen of a monitor 23 according to the eighth embodiment.

In step S801, the display control section 58 presents the second excavation distance progress degree calculated in step S800 to the operator through the monitor 23. As illustrated in FIG. 36, a progress degree display section 91 that displays the second excavation distance progress degree is provided on the screen of the monitor 23. The progress degree display section 91 displays the second excavation distance progress degree such that a right end of the progress degree display section 91 is set as a reference (progress degree of 0%), and a target excavation distance gage 92 extends toward a left end of the progress degree display section 91 (progress degree of 100%) as the second excavation distance progress degree is increased. FIG. 36 illustrates a case where the second excavation distance progress degree is 40%. Incidentally, the target excavation distance gage 92 may be set in a non-displayed state when the target first excavation distance is displayed in the display section 84*a*.

Advantages Obtained by Eighth Embodiment

When the target excavation distance gage 92 for the second excavation distance is additionally displayed on the monitor screen of the seventh embodiment, it is easy for the operator to grasp the progress degree of the second excavation distance intuitively. As for the display of the length D5 of the claw tip trajectory of the bucket 15 among the second excavation distances, in particular, it is difficult to display the length D5 in the assistance diagram within the assistance diagram display section 83. However, the length D5 can be displayed easily by using the target excavation distance gage 92 as in the present embodiment. It thereby becomes even easier to bring the excavation load close to the target value.

It is to be noted that the present invention is not limited to the foregoing embodiments, but includes various modifications within a scope not departing from the spirit of the present invention. For example, the present invention is not limited to including all of the configurations described in the foregoing embodiments, but includes configurations obtained by omitting a part of the configurations. In addition, a part of a configuration according to a certain embodiment can be added to or replaced with a configuration according to another embodiment.

In above description, the first excavation distance is the distance from the swing center of the upper swing structure 11 (predetermined reference point set to the hydraulic excavator) to the bucket claw tip position at a time of a start of excavation. However, a distance from the present bucket claw tip position (that is, the bucket claw tip position at a time of calculation of the bucket claw tip position) to the bucket claw tip position at the time of the start of the excavation (that is, a moving distance of the bucket claw tip from the present position to the excavation start position) may be set as the first excavation distance. In addition, similarly, while the second excavation distance is the distance from the bucket claw tip position at a time of a start of excavation to the bucket claw tip position at a time of an end of the excavation in the above description, a distance from a predetermined reference point set to the main body (the upper swing structure 11 and the lower track structure 10) of the hydraulic excavator to the bucket claw tip position at the time of the end of the excavation may be set as the second excavation distance.

In addition, it is needless to say that when the excavation distances are calculated, the reference point (claw tip position) on the bucket side and the reference point (swing center position) on the main body side of the hydraulic excavator may be calculated by using a positioning satellite system such as a GNSS (Global Navigation Satellite System) or the like.

In addition, a part or the whole of each configuration of the controller 21 described above and functions, execution processing, and the like of each such configuration may be implemented by hardware (for example, by designing logic for performing each function by an integrated circuit). In addition, the configurations of the controller 21 described above may be a program (software) that implements each function of the configurations of the controller 21 by being read and executed by a calculation processing device (for example, a CPU). Information related to the program can be stored in, for example, a semiconductor memory (a flash memory, an SSD, or the like), a magnetic storage device (a hard disk drive or the like), and a recording medium (a magnetic disk, an optical disk, or the like), and the like.

In addition, in the description of each of the foregoing embodiments, control lines and information lines construed as necessary for the description of the embodiments are illustrated. However, not all of control lines and information lines of a product are necessarily illustrated. Almost all configurations may be considered to be actually interconnected.

DESCRIPTION OF REFERENCE CHARACTERS

1 . . . Hydraulic excavator, 2 . . . Transporting machine (Dump truck), 12 . . . Front work device (Work device), 16, 17, 18 . . . Hydraulic cylinder (Actuator), 21 . . . Controller (Control system), 23 . . . Monitor (Display device), 50 . . . Work determining section, 51 . . . Claw tip position calculating section, 52 . . . Excavation distance calculating section, 53 . . . Excavation load calculating section, 54 . . . Work result storage section, 55 . . . Correspondence relation setting section, 56 . . . Target excavation load setting section, 56 . . . Target excavation distance calculating section, 58 . . . Display control section, 59 . . . Excavation environment setting section, 60 . . . By-excavation-environment work result storage section, 61 . . . Target achievement level determining section, 62 . . . Excavation distance storage section, 63 . . . Excavation distance tendency determining section, 64 . . . Target excavation distance notification determining section, 65 . . . Excavation-in-progress claw tip position storage section, 66 . . . Second excavation distance progress degree calculating section

The invention claimed is:

1. A work machine comprising:

a work device having a bucket;

an actuator configured to drive the work device;

a controller configured to determine excavation work being performed by the work device on a basis of at least one of posture information of the work device and load information of the actuator, and calculate an excavation load as a load value of an excavation target object excavated by the work device; and a display device configured to display the calculated excavation load, wherein the controller is configured to calculate, as an excavation distance, any one of a distance from a reference point set to the work machine to a reference point set to the bucket when it is determined that the excavation work is being performed and a distance by which the reference point set to the bucket moves while it is determined that the excavation work is being performed, on a basis of the posture information of the work device, store the calculated excavation load and the calculated excavation distance in association with each other, set correspondence relation between a target excavation load as a target value of the excavation load and a target excavation distance as a target value of the excavation distance on a basis of a tendency of correspondence relation between the stored excavation load and the stored excavation distance, set the target excavation load on a basis of rated capacity information of the bucket, and calculate the target excavation distance on a basis of the set correspondence relation and the set target excavation load, and the display device is configured to display the calculated target excavation distance.

2. The work machine according to claim 1, wherein the excavation distance is a first excavation distance as distance information from the reference point set to the work machine to a claw tip position of the bucket at a time of a start of the excavation work, and the display device is configured to display positional relation between an excavation start position distant from the reference point by the target excavation distance and the bucket.

3. The work machine according to claim 1, wherein the controller is configured to determine an achievement level of the excavation distance with respect to the target excavation distance on a basis of the calculated target excavation distance and the calculated excavation distance, and the display device is configured to display the achievement level as a determination result.

4. The work machine according to claim 1, wherein the controller is configured to store the calculated target excavation distance and the calculated excavation distance in association with each other, and determine a tendency of the excavation distance with respect to the target excavation distance by using the stored information, and the display device is configured to display a result of the determination.

5. The work machine according to claim 1, wherein the controller is configured to determine whether or not the target excavation load is less than a rated load of the bucket on a basis of the calculated target excavation load and the rated capacity information of the bucket, and the display device is configured to display the target excavation distance when it is determined in the determination that the target excavation load is less than the rated load of the bucket.

6. The work machine according to claim 1, wherein the controller is configured to set an excavation environment of the work machine, store the excavation load and the excavation distance in association with each other for each set excavation environment, set the correspondence relation between the target excavation load and the target excavation distance for each excavation environment by using the stored information, and calculate the target excavation distance on a basis of the set excavation environment, the set correspondence relation, and the set target excavation load.

7. The work machine according to claim 1, wherein the excavation distance includes a first excavation distance as distance information from the reference point set to the work machine to a claw tip position of the bucket at a time of a start of the excavation work and a second excavation distance as distance information from the claw tip position of the bucket at the time of the start of the excavation work to the claw tip position of the bucket at a time of an end of the excavation work, a position of a control point of the bucket when it is determined that the excavation work is started is calculated as the first excavation distance, and the second excavation distance is calculated on a basis of a history of the position of the control point of the bucket during a period that it is determined that the excavation work is being performed, the calculated excavation load and the calculated first excavation distance and the calculated second excavation distance are stored in association with each other, correspondence relation between the target excavation load as the target value of the excavation load and a target first excavation distance and a target second excavation distance as target values of the first excavation distance and the second excavation distance is set on a basis of a tendency of correspondence relation between the stored excavation load and the stored first excavation distance and the stored second excavation distance, the target first excavation distance and the target second excavation distance are calculated on a basis of the set correspondence relation between the set target excavation load and the target first excavation distance and the target second excavation distance and the set target excavation load, and the display device is configured to display the calculated target first excavation distance and the calculated target second excavation distance.

8. The work machine according to claim 7, wherein the controller is configured to calculate a second excavation distance progress degree as a ratio of the calculated second excavation distance with respect to the calculated target second excavation distance, and the display device is configured to display the calculated second excavation distance progress degree.

* * * * *